US009261855B2

(12) United States Patent
Fujinaka et al.

(10) Patent No.: US 9,261,855 B2
(45) Date of Patent: Feb. 16, 2016

(54) IMAGE FORMING APPARATUS

(71) Applicant: CANON KABUSHIKI KAISHA, Tokyo (JP)

(72) Inventors: Hiromi Fujinaka, Kawasaki (JP); Yuichiro Osawa, Kamakura (JP); Masao Amano, Susono (JP); Shigeru Hoashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 14/089,940

(22) Filed: Nov. 26, 2013

(65) Prior Publication Data

US 2014/0147158 A1 May 29, 2014

(30) Foreign Application Priority Data

Nov. 28, 2012 (JP) ..... 2012-259492
Nov. 28, 2012 (JP) ..... 2012-259493

(51) Int. Cl.
*G03G 21/16* (2006.01)
*G03G 21/18* (2006.01)

(52) U.S. Cl.
CPC ..... *G03G 21/1623* (2013.01); *G03G 21/1652* (2013.01); *G03G 21/1867* (2013.01)

(58) Field of Classification Search
CPC ..... G03B 15/02; G03B 15/0225; G03B 15/0258; G03B 21/06; G03B 21/08; G03B 2221/0042; G03B 2221/0063
USPC ..... 399/90, 98–99, 111–112
See application file for complete search history.

(56) References Cited

U.S. PATENT DOCUMENTS

| | | | |
|---|---|---|---|
| 7,715,752 | B2 | 5/2010 | Sakurai et al. |
| 8,145,096 | B2 | 3/2012 | Kawanami et al. |
| 8,213,828 | B2 | 7/2012 | Murayama et al. |
| 2008/0292355 | A1 | 11/2008 | Sakurai et al. |
| 2010/0104326 | A1 | 4/2010 | Tanaka |
| 2010/0124432 | A1 | 5/2010 | Takayama |
| 2010/0239314 | A1 | 9/2010 | Takayama |
| 2010/0329757 | A1 | 12/2010 | Souda |

(Continued)

FOREIGN PATENT DOCUMENTS

| | | | |
|---|---|---|---|
| JP | 2009-128506 | A | 6/2009 |
| JP | 2011-048047 | A | 3/2011 |

OTHER PUBLICATIONS

Great Britain Search and Examination Report dated May 19, 2014, in related Great Britain Patent Application No. GB1320370.8.

(Continued)

*Primary Examiner* — Christ Mahoney
(74) *Attorney, Agent, or Firm* — Fitzpatrick, Cella, Harper & Scinto

(57) ABSTRACT

An image forming apparatus include a door through which a tray carrying a cartridge passes. In a door closing operation, (i) movement of the tray from a movable position to an image forming position, (ii) movement of a drive transmission member, for transmitting a driving force to the cartridge from a main assembly, from a first spacing position to a drive-connecting position, (iii) movement of an urging member for urging the cartridge to the main assembly from a second spacing position to a contact position, and (iv) movement of an electric energy supply member, for supplying electric power to the cartridge from the main assembly, from a third spacing position to an electric energy supplying position, are carried out in the order named.

16 Claims, 22 Drawing Sheets

(56) References Cited

U.S. PATENT DOCUMENTS

| | | | | |
|---|---|---|---|---|
| 2011/0293324 | A1 | 12/2011 | Hoashi | |
| 2012/0045264 | A1 | 2/2012 | Shuhama et al. | |
| 2013/0156463 | A1* | 6/2013 | Jung et al. | 399/110 |
| 2013/0164049 | A1 | 6/2013 | Kawanami et al. | |
| 2014/0112679 | A1* | 4/2014 | Choi | 399/90 |

OTHER PUBLICATIONS

Great Britain Search and Examination Report dated May 27, 2015, in related Great Britain Patent Application No. GB1420997.7.

* cited by examiner (a)

(b)

(a)

(b)

IMAGE FORMING APPARATUS

FIELD OF THE INVENTION AND RELATED ART

The present invention relates to an image forming apparatus which forms an image on recording medium.

Here, an image forming apparatus is an apparatus which forms an image on recording medium with the use of one of various known image formation principles and methods such as an electrophotographic process, an electrostatic recording process, a magnetic recording process, etc. It includes a copying machine, a printer (laser printer, LED printer, etc.), a facsimile machine, a word processor, an image displaying apparatus (electronic blackboard, electronic whiteboard, etc.). Recording medium includes medium on which an image can be formed by an image forming apparatus. It includes a sheet of paper, an OHT sheet, an electronic display, and the like, for example.

A cartridge is a cartridge in which an image bearing member on which an image is formed, and all or parts of means for processing the image bearing member, are integrally disposed. It is removably installable in the main assembly of an image forming apparatus, and contributes to the process for forming an image on recording medium. The main assembly of an image forming apparatus is what remains after the removal of a cartridge from an image forming apparatus which employs the so-called cartridge system.

Some examples of an image bearing member are an electrophotographic photosensitive member used by an electrophotographic process, a dielectric member used by an electrostatic recording process, a magnetic member used by a magnetic recording process, etc. That is, they are various components on which an image can be formed with the use of one of various image formation principles and methods. A means for processing an image bearing member is a device which is used to process an image bearing member to form an image on the image bearing member.

Hereinafter, for convenience's sake, the present invention is described with reference to an electrophotographic image forming apparatus which employs a cartridge system. Examples of a cartridge are a process cartridge, a development cartridge, and the like.

A process cartridge is a cartridge in which an electrophotographic photosensitive member, and at least one among a charging means, a developing means, and a cleaning means, are integrally disposed, and which is removably installable in the main assembly of an electrophotographic image forming apparatus.

Thus, a process cartridge includes: a cartridge in which a developing means as a processing means, and an electrophotographic photosensitive member, are integrally disposed, and which is removably installable in the main assembly of an electrophotographic image forming apparatus; and a cartridge in which an electrophotographic photosensitive member, a charging means, and a developing means are integrally disposed, and which is removably installable in the main assembly of an electrophotographic image forming apparatus; and a cartridge in which an electrophotographic photosensitive member, a charging means, and a cleaning means are integrally disposed, and which is removably installable in the main assembly of an electrophotographic image forming apparatus.

A process cartridge in which an electrophotographic photosensitive member and a developing means are integrally disposed is referred to as a process cartridge of the so-called all-in-one type. In comparison, a process cartridge in which an electrophotographic photosensitive member and processing means other than a developing means are integrally disposed is referred to as a process cartridge of the so-called separation type. That is, a process cartridge of the separation type does not have a developing means. Therefore, it has to be used in combination with a development unit which has a developing means.

A process cartridge can be installed into, or removed from, the main assembly of an image forming apparatus by a user by himself or herself. Thus, it can make an image forming apparatus easier to maintain.

A development cartridge has a developer bearing member (which may be referred to as development roller, hereafter) which supplies an electrophotographic photosensitive member with developer. It stores powdery developer (toner) which is used by a development roller to develop an electrostatic latent image formed on an electrophotographic photosensitive member. It also is removably installable in the main assembly of an electrophotographic image forming apparatus.

In the case of an electrophotographic image forming apparatus which employs a development cartridge, its electrophotographic photosensitive member is attached to the main assembly or cartridge supporting member of the main assembly of the apparatus, or is a part of the aforementioned process cartridge of the so-called separation type (which does not have developing means). A development cartridge also can be removably installable in the main assembly of an electrophotographic image forming apparatus. Thus, it can make an electrophotographic image forming apparatus easier to maintain.

That is, a process cartridge includes both a process cartridge of the so-called all-in-one type, and a process cartridge of the so-called separation type. Further, it includes a development cartridge which is used in combination with a process cartridge of the so-called separation type. Further, it includes a development cartridge which is removably installable in the main assembly of an electrophotographic image forming apparatus, the electrophotographic photosensitive member of which is fixed to the main assembly or cartridge supporting member of the apparatus, so that it can process the electrophotographic photosensitive member. In other words, a cartridge includes a unit which can be removably installable in the main assembly of an electrophotographic image forming apparatus so that it can contribute to the image forming process carried out by the apparatus to form an image on recording medium.

Some conventional image forming apparatuses are provided with a movable tray (movable member; cartridge supporting member) on which multiple process cartridges are horizontally aligned. They are structured so that the tray can be pulled out of their main assembly, and also, so that when the tray is outside their main assembly, the process cartridge are placed on, or removed from, the tray.

Some of the above-described image forming apparatuses with a movable tray are provided with a cover which can cover or expose the opening with which their main assembly is provided to allow the tray to be pulled out of the main assembly. They are structured so that as the cover is opened or closed, their interfacing members are placed in contact, or separated from, the corresponding portions of each of the cartridges in the main assembly (Japanese Laid-open Patent Application 2009-128506). The interfacing members include a member which presses and keeps pressed a cartridge, a member which engages with a cartridge to transmit cartridge driving force to the cartridge, and a member which supplies a cartridge with electric power, for example.

The conventional image forming apparatus disclosed in Japanese Laid-open Patent Application 2009-128506 is structured so that its member for supporting its tray is moved in the frontward or rearward, and also, in the upward or downward, directions of the main assembly, by the rotational movement of its front door. More specifically, as the door is closed, the tray holding member is moved rearward while being moved downward, and then, is moved further rearward, by the movement of the door.

As the tray and the cartridges thereon are moved by the above described downward movement of the tray holding member, the electric power supplying members, with which the main assembly of the image forming apparatus is provided, come into contact with the intermediary contacts, with which the tray is provided, from the bottom side of the tray. Then, as the tray supporting member is moved further rearward, the cartridge pressing members come into contact with the cartridges from the top side of the tray (cartridges), and at the same time, the driving force transmitting couplings (driving force transmitting members) engage with the driving force input portions of the cartridges.

As the door is opened, the interfacing members are separated from the counterparts of the corresponding cartridges, one for one, in the opposite order from the above-described one in which they are engaged. In other words, the conventional image forming apparatus disclosed in Japanese Laid-open Patent Application 2009-128506 is structured so that the cartridges in its main assembly can be easily replaced from the front side of the apparatus.

SUMMARY OF THE INVENTION

The present invention is one of the results of further development of the above described prior art.

Thus, the primary object of the present invention is to provide an image forming apparatus which is similar in structure to the above described one, and yet, is substantially smaller in the amount of the force of which an operator is required to open or close the door of the apparatus, and can ensure that as a cartridge or cartridges are installed into the main assembly of the apparatus, it is accurately placed in their preset image formation position in the main assembly.

According to an aspect of the present invention, there is provided an image forming apparatus for forming an image on a recording material, to which apparatus a cartridge is detachably mountable, said image forming apparatus comprising a main assembly; an opening provided in said main assembly; a main assembly door movable between a closing position for closing said opening and an open position for opening said opening; a tray for carrying said cartridge, said tray is capable of taking (i) an image forming position in which said cartridge is in a position capable of image forming operation in said main assembly, when said main assembly door is in the closing position, (ii) a mounting and demounting position for permitting mounting and demounting of said cartridge outside said main assembly, when said main assembly door is in the open position, and (iii) a movable position which is between the mounting and demounting position and the image forming position and in which said tray is movable to the image forming position in interrelation with movement of main assembly door from the open position to the closing position; a supporting member movably supporting said tray and movable in interrelation with said main assembly door; a drive transmission member capable of taking a connecting position for transmitting a driving force to said cartridge when said main assembly door is in the closing position, and a first spacing position for spacing from said cartridge when said main assembly door is in the open position; an urging member capable of taking a contact position in which said urging member urges said cartridge to said main assembly when said main assembly door is in the closing position, and a second spacing position for spacing from said cartridge when said main assembly door is in the open position; and an electric energy supply member capable of taking an electric energy supplying position for supplying electric energy to an electric power supply contact portion of said cartridge when said main assembly door is in the closing position, and a third spacing position for spacing from said electric power supply contact portion of said cartridge when said main assembly door is in the open position, wherein in interrelation with the movement of said main assembly door from the open position to the closing position, (i) movement of said tray from the movable position to the image forming position, (ii) movement of said drive transmission member from the first spacing position to the connecting position, (iii) movement of said urging member from the second spacing position to the contact position, and (iv) movement of said electric energy supply member from the third spacing position to the electric energy supplying position, are carried out in the order named.

According to another aspect of the present invention, there is provided an image forming apparatus for forming on a recording material, to which apparatus a cartridge is detachably mountable, said image forming apparatus comprising a main assembly; an opening provided in said main assembly; a main assembly door movable between a closing position for closing said opening and an open position for opening said opening; a tray for carrying said cartridge, said tray is capable of taking (i) an image forming position in which said cartridge is in a position capable of image forming operation in said main assembly, when said main assembly door is in the closing position, (ii) a mounting and demounting position for permitting mounting and demounting of said cartridge outside said main assembly, when said main assembly door is in the open position; an urging member for urging said cartridge carried on said tray in a longitudinal direction of said cartridge which is from one longitudinal end to the other longitudinal end of said cartridge; and a fixed side plate opposed to the other end portion side of said cartridge carried on said tray, wherein said cartridge is provided at the other end portion with a positioning portion, and wherein when said tray carrying said cartridge is in the image forming position, said positioning portion is contacted to said side plate by said cartridge being urged by said urging member so that said cartridge is positioning in the longitudinal direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

<<Overall Structure of Image Forming Apparatus>>

Figure 1:
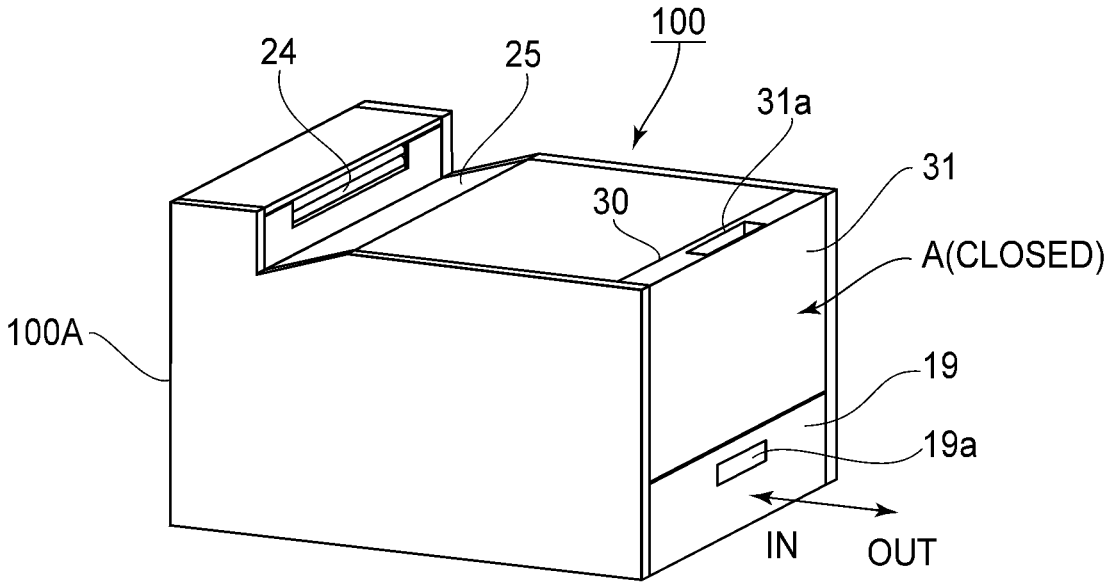
FIG. 1 is an external perspective view of a typical image forming apparatus (in first embodiment of present invention) to which the present invention is applicable.
Figure 2:
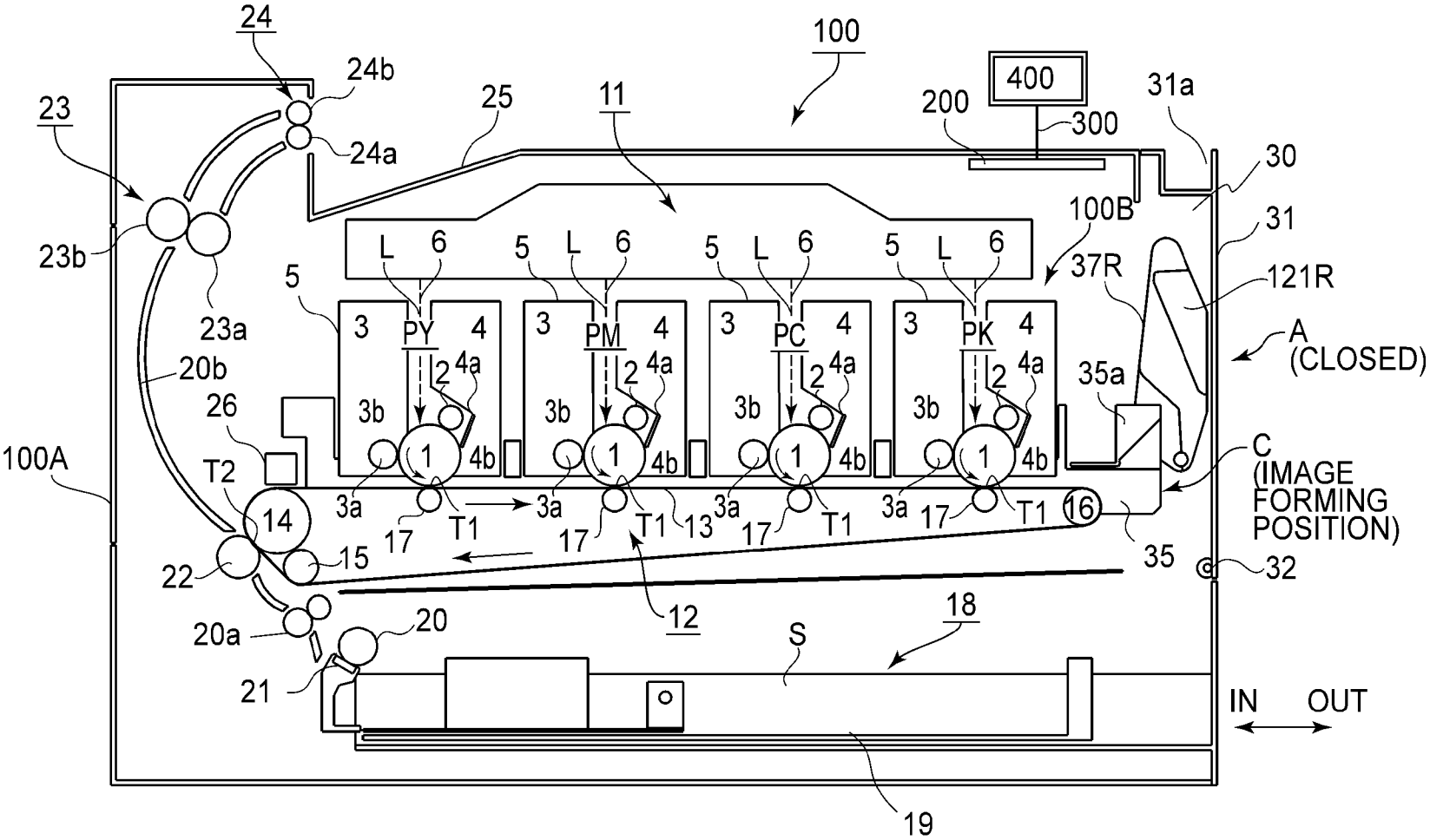
FIG. 2 is a schematic sectional view of the image forming apparatus in the first embodiment, at a vertical plane parallel to the recording medium conveyance direction of the apparatus, as seen from the left-hand side of the apparatus.

FIG. 1 is an external perspective view of the image forming apparatus 100 in the first embodiment of the present invention. FIG. 2 is a schematic sectional view of the apparatus 100, at a vertical plane parallel to the recording medium conveyance direction of the apparatus 100, as seen from the left-hand side of the apparatus 100. The image forming apparatus 100 is a full-color laser printer (electrophotographic image forming apparatus) based on four primary colors. It uses an electrophotographic process, and employs multiple (four) cartridges P, more specifically, the first to fourth cartridges PY, PM, PC and PK, respectively.

That is, this image forming apparatus 100 can form a full-color image (based on four primary colors) or a monochromatic image on a sheet S of recording medium, in response to electrical image formation signals which are outputted from an external host apparatus 100 and are inputted into the control section 200 of the image forming apparatus 100 through an interface portion 300. The external host apparatus 400 is a personal computer, an image reader, a facsimile apparatus from which electrical image formation signals are sent, etc.

The control section 200 is a controlling means which controls the electrophotographic image formation process carried out by the image forming apparatus 100. It exchanges various electrical information with the external host apparatus 400. Further, it processes: the electrical information inputted from various processing devices and sensors; and command signals to be outputted to the various processing devices. Further, it controls the preset initial sequence, preset electrophotographic image formation sequence, etc.

In the description of the following embodiments of the present invention, the front side (front surface side) of the image forming apparatus 100 is the side on which the door (main assembly door) 31 is present. The rear side (rear surface side) is the opposite side of the image forming apparatus 100 from the front side. The front-rear direction includes both the rear-to-front (frontward) direction and front-to-rear (rearward) direction. The left and right of the image forming apparatus 100 are the left and right of the apparatus 100 when the apparatus 100 is seen from the front side of the apparatus 100. The left-right direction (rightward direction) includes both the left-to-right direction and the opposite direction from the left-to-right direction (rightward direction). Further, the upward and downward directions of the apparatus 100 are the upward and downward direction with reference to the gravity direction. The upward direction is the bottom-to-top direction of the apparatus 100. The downward direction is the top-to-bottom direction.

Further, the lengthwise direction is the direction which is parallel to the rotational axis of the electrophotographic photosensitive member, or an image bearing member, on which a latent image is formed. The widthwise direction is the direction which is perpendicular to the above described lengthwise direction (perpendicular direction). Moreover, one of the two ends in terms of the lengthwise direction is the driving end, whereas the other lengthwise end is the no-driving end. In this embodiment, the right side of the image forming apparatus 100 in terms of the lengthwise direction is the driving side, and the left side of the apparatus 100 is the no-driving side.

The main assembly 100A (main assembly frame) of the image forming apparatus 100 has an internal chamber 100B (cartridge chamber 100B, hereafter) in which cartridges are installed. This cartridge chamber 100B can hold four cartridges, more specifically, first to fourth cartridges PY, PM, PC and PK, in the positions designated to the four cartridges, respectively, in such a manner that the four cartridge horizontally align in parallel (tandem) in the rear-to-front direction in the listed order (inline structure; tandem type). The designated cartridge position in the cartridge chamber 100B, or the position designated to a given cartridge, in the cartridge chamber 100B, is the position in which the cartridge can actually contribute to an image forming operation.

The cartridge P contributes to the image formation process for forming an image on a sheet S of recording medium. It is removably installed in the apparatus main assembly 100A of the image forming apparatus 100 to be used for image formation. In this embodiment, each of the four cartridges P has an electrophotographic photosensitive member (which will be referred to simply as drum, hereafter) 1, as an image bearing member, on which a latent image is formed. Each cartridge P has also a charging means 2, a developing means 3, and a cleaning means 4, which are for electrophotographically processing the drum 1. In other words, the process cartridge in this embodiment is a process cartridge of the so-called all-in-one type.

In this embodiment, the charging means 2 is a charge roller of the contact type. The developing means 3 is a developing device of the contact, or non-contact, type. It has a development roller 3*a*, as a developer bearing member, which develops a latent image into a developer image (image formed of developer) by supplying the drum 1 with developer. It has also a developer storage 3*b* which stores developer. The cleaning means 4 is a cleaning device of the blade type. It has a cleaning blade 4*a* as a cleaning member, a waste toner storage 4*b*, etc. Further, each cartridge P has its own mechanism for electrophotographically processing its own drum 1; it has its own devices, such as the above-described ones, for forming an image. That is, the four cartridges P are the same in configuration except for the color of the developer (which will be referred to as toner) they store.

That is, the first cartridge PY stores yellow (Y) toner in its developing device 3. It forms a yellow (Y) toner image on the peripheral surface of its drum 1. The second cartridge PM stores magenta (M) toner in its developing device 3. It forms a magenta (M) toner image on the peripheral surface of its drum 1. The third cartridge PC stores cyan (C) toner in its developing device 3. It forms a cyan (C) toner image on the peripheral surface of its drum 1. The fourth cartridge PK stores black (K) toner in its developing device 3. It forms a black (K) toner image on the peripheral surface of its drum 1.

The apparatus main assembly 100A is provided with a laser scanner unit 11 as an exposing device unit (exposing means) for exposing the drum 1 of each cartridge P to form a latent image on the drum 1. The laser scanner unit 11 is disposed so that it will be on the top side of the cartridges PY, PM, PC and PK after the installation of the cartridges into the cartridge chamber 100B. This scanner unit 11 scans (exposes) the peripheral surface of the drum 1 of each cartridge P, through the exposure window 6, with which the top wall of the cartridge frame 5 is provided, by outputting a beam L of laser light while modulating the beam L according to the information regarding the color of the monochromatic image, which is inputted into the control section 200 from the external host apparatus 400.

The apparatus main assembly 100A is also provided with an intermediary transfer unit 12 as an image transferring unit (transferring member), onto which the toner image formed on the peripheral surface of the drum 1 of each cartridge P is transferred (primary transfer), and from which the transferred toner image is transferred (secondary transfer) onto a sheet S of recording medium. The intermediary transfer unit 12 is disposed so that it will be on the bottom side of the cartridges P after the installation of the cartridges P in the cartridge chamber 100B.

This unit 12 has an endless belt 13, a driver roller 14, a turn roller 15, and a tension roller 16. The endless belt 13 is the intermediary transferring member (second image bearing member, intermediary recording medium). It is made of a dielectric substance, and is flexible. It is wrapped around the combination of the rollers 14, 15 and 16, and is circularly moved while being kept tensioned. The driver roller 14 and turn roller 15 are in the rear side of the apparatus main assembly 100A, whereas the tension roller 16 is in the front side of the apparatus main assembly 100A.

When each cartridge P is in its preset position (image formation position) in the apparatus main assembly 100A, the downwardly facing portion of its drum 1 is in contact with the upwardly facing surface of the portion of the belt 13, which corresponds in position to the top portion of the loop (belt loop, hereafter) which the belt 13 forms. There are disposed four primary transfer rollers 17 on the inward side of the belt loop, being positioned so that they oppose the drums 1 in the cartridges P, one for one, with the presence of the belt 13 between themselves and drums 1.

The nip which the drum 1 in each cartridge P, and the belt 13, form is the primary transfer nip T1. The apparatus main assembly 100A is provided with a secondary transfer roller 22, which is pressed against the driver roller 14, with the presence of the belt 13 between the rollers 14 and 22. The nip between the secondary transfer roller 22 and belt 13 is the secondary transfer nip T2.

There is disposed a sheet feeder unit 18 below the intermediary transfer unit 12. The sheet feeder unit 18 stores multiple sheets S of recording medium (which may be referred to simply as recording medium), onto which a toner image is transferred. Further, it feeds the sheets S of recording medium, one by one, into the apparatus main assembly 100A, and conveys further to the intermediary transfer unit 12.

This sheet feeder unit 18 has: a sheet feeder tray 19 in which multiple sheets S of recording medium (which may be referred to simply as regarding medium) are stored in layers; a sheet feeder roller 20, a separation pad 21, a pair of registration rollers 20*a*; etc. The sheet feeder tray 19 is removable from the apparatus main assembly 100A; it can be pulled out of, or inserted into, the apparatus main assembly 100A, from the front side of the apparatus main assembly 100A (front loading). A referential code 19*a* stands for a handhold with which the front plate of the sheet feeder tray 19 is provided.

The apparatus main assembly 100A is provided with a fixing device 23 and a pair of sheet discharging rollers 24, which are in the top portion of the rear side of the apparatus main assembly 100A. The fixing device 23 is a fixation unit (fixing means) which fixes an unfixed toner image on a sheet S of recording medium to the sheet S, by applying heat and pressure to the sheet S and the toner image thereon, and then, discharges the sheet S. A part of the top surface of the apparatus main assembly 100A is shaped so that it functions as a delivery tray 25. The fixing device 23 used in this embodiment is such a fixing device that has a fixation film assembly 23*a* and a pressure roller 23*b*. The pair of sheet discharging rollers 24 are rollers 24*a* and 24*b*.

As the cartridges P are installed into the apparatus main assembly A, they are placed into the cartridge chamber 100B in such a manner that they are placed in their designated positions in which they are usable for an image forming operation, remaining pressed by a cartridge pressing members 42 (FIG. 22) one for one, as will be described later. Further, the driving force output portions (driving force transmitting members) 39 and 40 (FIGS. 24 and 25) of the apparatus main assembly 100A engage with the driving force input portions (coupling portions) 53 and 54 (FIG. 8) of the cartridges P, as will be described later. Further, electrical connection is established between the electric power supplying system (electric power supplying member) 75 (FIG. 18) of the apparatus main assembly 100A and the electrical contacts (electric power supply contacts) 55 of the cartridges P (FIG. 7), as will be described later.

<<Image Forming Operation>>

The operation carried out by the image forming apparatus 100 in this embodiment to form a full-color image is as follows. First, the drum 1 in each of the first to fourth cartridges PY, PM, PC and PK begins to be rotationally driven in the counterclockwise direction indicated by an arrow mark FIG. 2, at a preset control speed. At the same time, the belt 13 begins to be circularly moved in the clockwise direction (the same direction as the direction in which the peripheral surface of the drum 1 moves in the area of contact between the belt 13 and drum 1), at a speed which corresponds to the peripheral velocity of the drum 1. Further, the scanner unit 11 also begins to be driven.

In synchronism with the starting of the driving of the abovementioned components, the charge roller 2 in each cartridge P begins to uniformly charge the peripheral surface of the drum 1 in the cartridge P to preset polarity and potential level. The scanner unit 11 begins to scan (expose) the uniformly charged portion of each drum 1, with the beam L of laser light which it outputs while modulating the beam L according to the image formation signals, which correspond in color to one of the monochromatic primary color images, into which the image to be formed has been separated. Consequently, an electrostatic latent image, which reflects the image signals, is formed on the peripheral surface of each drum 1. Then, the latent image is developed into a toner image (image formed of toner (developer)) by the corresponding developing device 3.

Through the electrophotographic image formation process described above, a yellow (Y) toner image, which corresponds in color to the yellow component of the full-color image to be formed, is formed on the drum 1 of the first cartridge PY. Then, the toner image is transferred (primary transfer) onto the belt 13, in the primary transfer nip T1 of the cartridge PY.

On the drum 1 of the second cartridge PM, a magenta (M) toner image, which corresponds in color to the magenta (M) component of the full-color image, is formed. Then, the magenta (M) toner image is transferred (primary transfer) onto the belt 13, in the primary transfer nip T1 of the cartridge PM, in such a manner that it is layered onto the yellow (M) toner image which has already been transferred onto the belt 13.

On the drum 1 of the third cartridge PC, a cyan (C) toner image, which corresponds in color to the cyan (C) component of the full-color image, is formed. This toner image is transferred (primary transfer) onto the belt 13, in the primary transfer nip T1 of the cartridge PM, in such a manner that it is layered upon the yellow (Y) and magenta (M) toner images, which have just been transferred onto the belt 13.

On the drum 1 of the fourth cartridge PK, a black (K) toner image, which corresponds in color to the black (K) component of the full-color image, is formed. This toner image is transferred (primary transfer) onto the belt 13, in the primary transfer nip T1 of the cartridge PK, in such a manner that it is layered onto the yellow (Y), magenta (M) and cyan (C) toner images which have already been transferred onto the belt 13.

Consequently, an unfixed full-color toner image is synthetically effected on the belt 13 by the layered four monochromatic yellow (Y), magenta (M), cyan (C) and black (K) toner images on the belt 13. The transfer residual toner, that is, the toner remaining on the peripheral surface of the drum 1 in each cartridge P after the primary transfer of the toner image onto the belt 13, is removed by the cleaning device 4 of the cartridge P.

Meanwhile, the feed roller 20 begins to be driven with a preset control timing, whereby the multiple sheets S of recording medium are fed into the apparatus main assembly 100A one by one, while being separated from each other by the coordination between the feed roller 20 and separation roller 21, and are conveyed to the pair of registration rollers 20*b*. Then, each sheet S of recording medium is introduced by the registration rollers 20*b* into the secondary transfer nip T2 with a preset control timing. Then, the sheet S is conveyed through the secondary transfer nip T2 while remaining pinched between the secondary transfer roller 22 and driver roller 14. While the sheet S is conveyed through the secondary transfer nip T2, the four monochromatic toner images, different in color, layered on the belt 13 are transferred together onto the surface of the sheet S as if they are peeled away from the belt 13.

Then, the sheet S of recording medium is separated from the surface of the belt 13, and is introduced into the fixing device 23 through the recording medium conveyance passage 20*b*. Then, it is subjected to heat and pressure in the fixation nip N of the fixing device 23. Consequently, the layered four monochromatic toner images, different in color, on the sheet S are fixed to the sheet S. Thereafter, the sheet S is conveyed out of the fixing device 23, and is discharged as a full-color print by a pair of discharge rollers 24 into the delivery tray 25.

The secondary transfer residual toner, that is, the toner remaining on the surface of the belt 13 after the separation of the sheet S from the belt 13, is removed by the cleaning means 26.

<<Method for Replacing Cartridge in Apparatus Main Assembly 100A>>

As each of the first to fourth cartridges PY, PM, PC and PK is used for image formation, the developer in the developing device 3 of each cartridge P is consumed for the image formation. Thus, as the developer in any of the cartridges PY, PM, PC and PK is consumed so much for image formation that the amount of the developer remaining in the cartridge P is not large enough for the image forming apparatus 100 to yield an image which is high enough in quality to satisfy the user who purchased the cartridge P, the cartridge loses its commercial value.

Thus, the image forming apparatus 100 is provided with a means (unshown) for detecting the amount of the toner remaining in each cartridge P so that the detected amount of the developer in the cartridge P is compared by the control section 200 with a threshold value which is preset to inform a user of the remaining length of the service life of the cartridge, and/or warning the user that the cartridge P is near the end of its service life. If the control section 200 determines that the detected amount of the developer in a given cartridge is less than the threshold value, it shows a message that indicates the remaining length of the service life of the cartridge P, or warns the user that the cartridge P is near the end of its service life, on the display section (unshown) of the apparatus main assembly 100A, prompting thereby the user to prepare a replacement cartridge, and/or to replace the cartridge P in the apparatus main assembly 100A with a replacement cartridge to keep the image forming apparatus 100 at a preset level in terms of the quality of the image the image forming apparatus 100 outputs.

For the purpose of improving the image forming apparatus 100 in this embodiment in usability, the image forming apparatus 100 is provided with a cartridge tray (drawer, movable member) 35, in which the cartridges P are placed. The image forming apparatus 100 is structured so that the cartridge tray 35 can be pulled out, or pushed into, the apparatus main assembly 100A from the front side of the apparatus main assembly 100A (front access type).

More specifically, the front wall of the apparatus main assembly 100A is provided with an opening 30 through which the cartridges P can be inserted into, or removed from, the cartridge chamber 100 B in the apparatus main assembly 100A.

Referring to FIGS. 1 and 2, the apparatus main assembly 100A is provided with a main assembly door 31 (member which can be opened or closed), which is movable between the position A (closed position), in which it covers the opening 30, and the position B (open position), in which it exposes the opening 30. A referential code 31*a* stands for a recess in which a finger can be placed to open or close the door 31. That is, the main assembly door 31 is enabled to take the closed position A, in which it covers the opening 30, and the open position B, in which it keeps the opening 30 fully exposed.

In this embodiment, the door 31 is pivotally opened or closed relative to the apparatus main assembly 100A about a horizontal shaft (hinge shaft) 32 which is located at the bottom edge of the door 31. That is, the door 31 can be pivotally moved about the hinge shaft 31, into its upright position in which it is shut against the apparatus main assembly 100A. As the door 31 is shut, the opening 30 is covered.

Further, the door 31 can be pivotally moved frontward about the hinge shaft 32, into a roughly horizontal position, in which it keeps fully exposed the opening 30 of the front wall of the apparatus main assembly 100A. The recess 31a with which the door 31 is provided is where the finger(s) of an operator can be put to open or close the door 31.

Next, referring to FIGS. 13 - 15, 17, 19, 23, etc., the apparatus main assembly 100A is provided with a main frame (main assembly frame), which has a pair (left and right) of sub-frames 80L and 80R. The apparatus main assembly 100A is also provided with a pair (left and right) of tray holding members (movable means) 34L and 34R, which are positioned on the inward side of the sub-frames 80L and 80R, respectively. The tray holding members 34L and 34R oppose each other, and extend in the front-rear direction.

Further, the apparatus main assembly 100A is provided with a cartridge tray (movable member) 35, which is shaped like a skeletal frame, and is rested on the tray holding members tray holding members 34L and 34R, being thereby enabled to horizontally (in parallel to surface on which apparatus main assembly 100A is resting) and linearly move in the front-rear direction, between the left and right sub-frames 80L and 80R. The cartridges PY, PM, PC and PK are supported in the apparatus main assembly 100A by being mounted in this tray 35. That is, the tray 35, which is a movable member, is for supporting and moving the cartridges P. It is movable between the mutually opposing lateral sub-frames (plates) 80L and 80R, which function as the parts (sub-frames) of the main frame of the apparatus main assembly 100A.

Referring to FIGS. 1 and 2, when the door 31 is in its closed position A, the tray 35 is in its image formation position (inward position) C, in which it keeps each cartridge P in the tray 35 in the image formation position (inward position). In this embodiment, the image formation position C of the tray 35 is such a position for the tray 35 that keeps the drum 1 in each cartridge P in the tray in contact with the belt 13 of the intermediary transfer unit 12 (FIG. 2).

Figure 4:
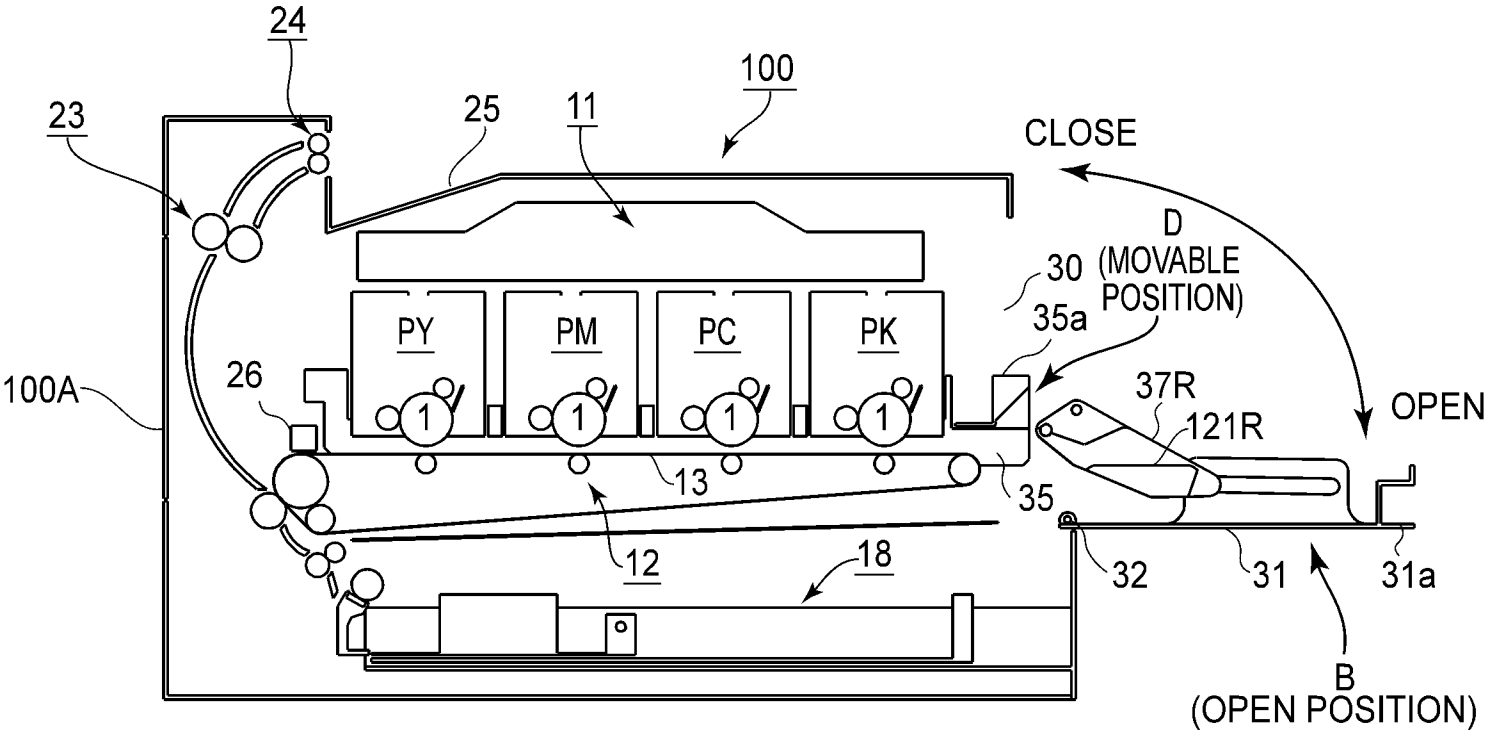
FIG. 4 is a schematic sectional view of the image forming apparatus in the first embodiment, at a vertical plane parallel to the recording medium conveyance direction of the apparatus, as seen from the left-hand side of the apparatus when the front door of the apparatus is wide open.

Thus, as the door 31 is opened (pivotally moved frontward), the tray holding members 34L and 34R are moved frontward by a preset amount, and then, are moved upward by a preset amount, by the movement of the door 31. Consequently, the tray 35, in which the cartridges PY, PM, PC and PK are held, is moved frontward, and then, upward, from its image formation position C, described above, as shown in FIG. 4, being thereby moved into a locking (unlocking) position D, in which the tray 35 can be unlocked from the tray holding members 34*l* and 34R to be horizontally movable in the front-rear direction, or locked to the tray holding members 34L and 34R. As the tray 35 is moved as described above, the drum 1 in each cartridge P in the tray 35 separates from the belt 13 as shown in FIG. 4. The mechanism which causes the movement of the door 31 to move the tray holding members 34L and 34R will be described later.

As will be described later, also as the door 31 is opened, the electrical connection between the electrical contact 55 of each cartridge P and the electric power supply system 75 of the apparatus main assembly 100A is interrupted (electric power supply interruption) by the pivotal opening movement of the door 31. Further, the driving force input portions 53 and 54 of each cartridge P are disengaged from the driving force output portions 39 and 40 of the apparatus main assembly 100A (disabling of driving force transmission) by the movement of the door 31. Further, each cartridge P is freed from the pressure applied by the corresponding pressing member 42 to keep the cartridge P properly positioned (pressure removal).

Figure 3:
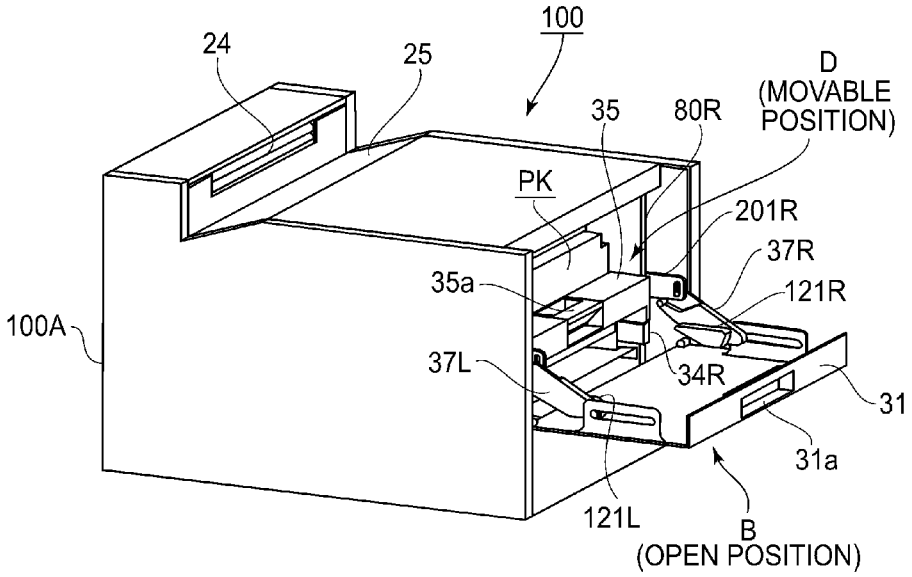
FIG. 3 is an external perspective view of the image forming apparatus shown in FIG. 1, when the front door of the apparatus is wide open.
Figure 15:
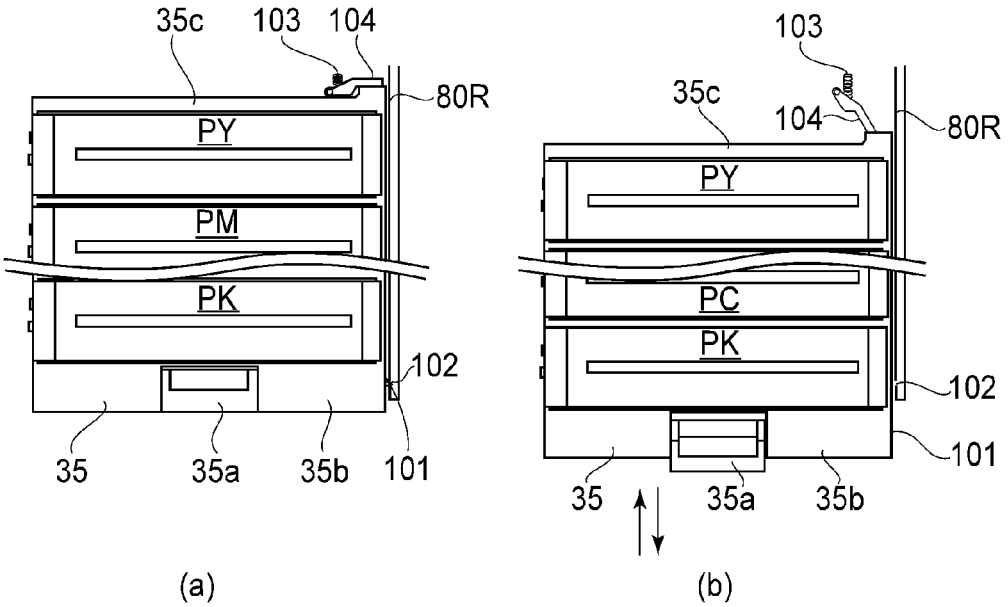
FIG. 15 is a sectional view (3) of the tray position regulating means.

Referring to FIGS. 3 and 4, next, an operator is to grasp the handhold (tray unlocking means) 35*a* with which the front portion 35*b* of the tray 35 is provided. Grasping the handhold 35*a* in a preset manner causes the tray locking latch (tray movement regulating means) 101 of the tray 35 to disengage from the catch portion (tray movement regulating means) 102 of the main assembly 100A, as shown in FIG. 15(*a*)→15(*b*).

Figure 5:
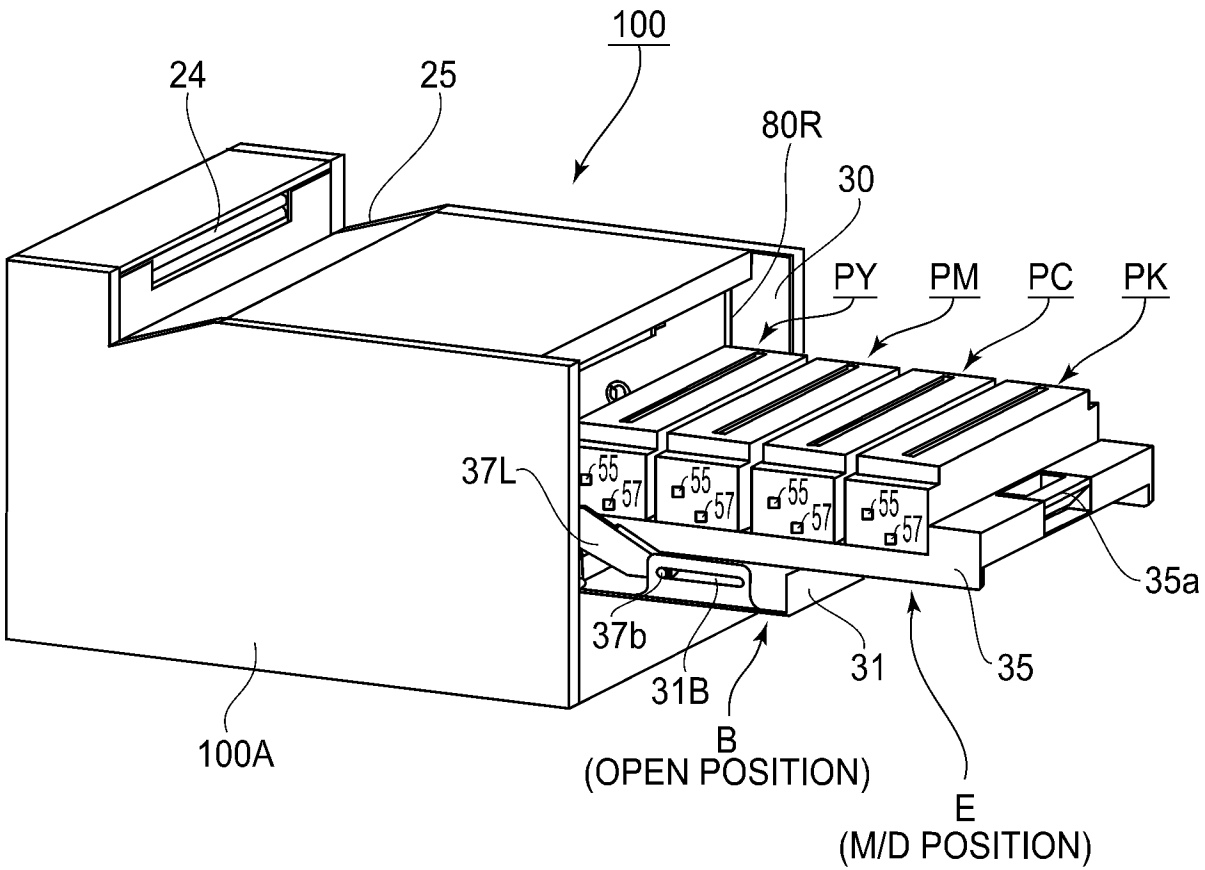
FIG. 5 is an external perspective view of the image forming apparatus shown in FIG. 1, when the cartridge tray of the apparatus is in its outermost position.
Figure 6:
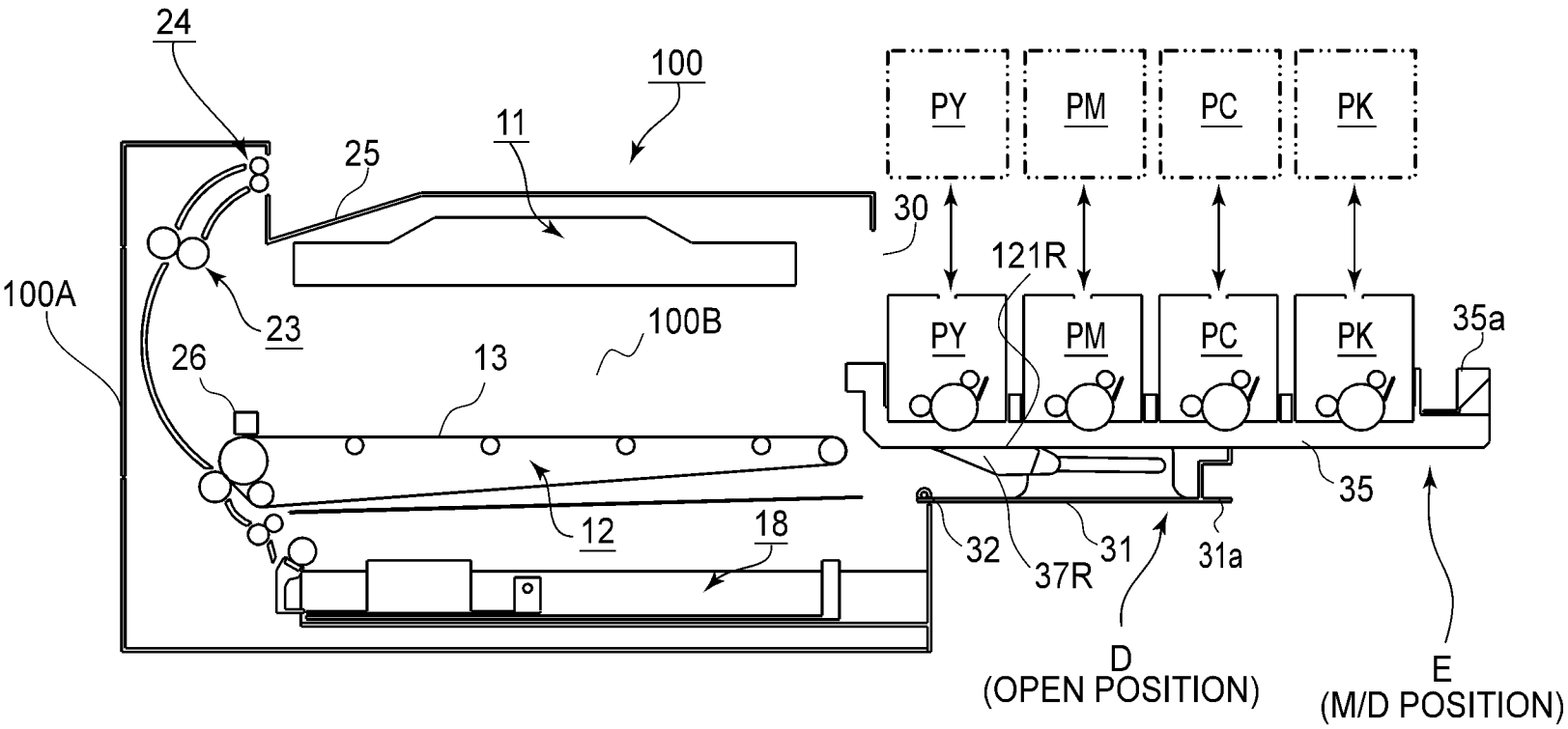
FIG. 6 is a schematic sectional view of the image forming apparatus in the first embodiment, at a vertical plane parallel to the recording medium conveyance direction of the apparatus, as seen from the left-hand side of the apparatus when the cartridge tray of the apparatus is in its outermost position.

Consequently, it becomes possible for the tray 35, which is in the tray locking (unlocking) position D in the apparatus main assembly 100A, to be pulled out of the apparatus main assembly 100A. More specifically, it becomes possible for the tray 35 to be horizontally slid frontward along the tray holding members 34L and 34R. Thus, the tray 35 can be pulled out of the apparatus main assembly 100A, and made to protrude into its preset outward position, that is, the cartridge mounting (dismounting) position E which makes it possible for the cartridges P to be mounted into, or removed from, the tray 35, in a preset manner, as shown in FIGS. 5 and 6.

That is, the first to fourth cartridges PY, PM, PC and PK held by the tray 35 are moved out of the apparatus main assembly 100A through the opening 30, and become fully exposed from the apparatus main assembly 100A; the top surface of each cartridge P becomes exposed. As the tray 35 is pulled out of the apparatus main assembly 100A by a sufficient amount, that is, as the tray 35 is moved outward of the apparatus main assembly 100A by a preset amount from the tray locking (unlocking) position D, it is prevented by an unshown stopper from being pulled out farther. Further, after the tray 35 is horizontally pulled out to the cartridge mounting (dismounting) position E, it is horizontally held in the cartridge mounting (dismounting) position E by the tray holding members 34L and 34R, and a pair of linkage arms 37L and 37R, which will be described later.

When the tray 35 is in its cartridge mounting (dismounting) position E, it is supporting the cartridges P in such a manner that each cartridge P can be vertically (upwardly) moved out of the tray 35. Incidentally, each cartridge P can be held by the tray 35 by being vertically (downwardly) moved into the tray 35. Thus, if a given cartridge is used up, and therefore, needs to be replaced, it is to be vertically lifted from the tray 35, as indicated by a broken line in FIG. 6, so that it can be extracted from the tray 35. Then, a brand-new cartridge (or used cartridge which still contains usable amount of developer) is to be mounted (fitted into) on the tray 35 from the top side of the tray 35. That is, it is after the tray 35 was pulled out of the apparatus main assembly 100A that the cartridges P are mounted on, or extracted from, the tray 35 so that they can be moved into, or extracted from, the apparatus main assembly 100A.

In the case of the image forming apparatus 100 in this embodiment, the tray 35 supports the cartridges PY, PM, PC and PK in the listed order, in terms of the upstream side to the downstream side in terms of the direction in which the tray 35 is moved from the tray locking (unlocking) position D to the cartridge mounting (dismounting) position E. That is, as the cartridges PY, PM, PC and PK, in which yellow (Y), magenta (M), cyan (C) and black (K) developers, respectively, are stored, are mounted into the tray 35, they align in the listed order. That is, among the multiple cartridges P, which are different in the color of the toner they contain, the cartridge PK which contains the black (K) developer is supported in the most downstream slot in the tray 35 in terms of the direction in which the tray 35 is moved from the tray locking (unlocking) position D to the cartridge mounting (dismounting) position E.

The cartridge PK is greater in developer consumption than the other cartridges P. That is, it is highest in replacement frequency. In other words, the cartridge PK, which is likely to be most frequently replaced, is supported by the frontmost portion of the tray 35 (frontmost portion of apparatus main assembly 100A). Therefore, all that is necessary to be done to expose the cartridge PK from the apparatus main assembly 100A to replace the cartridge PK is to pull the tray 35 out of the apparatus main assembly 100A by the amount large enough to expose only the cartridge PK. In other words, when it is only the cartridge PK that needs to be replaced, it is unnecessary for the tray 35 to be pulled out of the apparatus main assembly 100A all the way until the outward movement of the tray 35 is regulated by the stopper. In other words, this structural arrangement improves an electrophotographic image forming apparatus which employs a cartridge system, in the efficiency with which the cartridge PK can be replaced.

That is, when it is the cartridge PK, that is, the cartridge which is positioned most downstream in the tray 35 in terms of the direction in which the tray 35 is pulled out of the apparatus main assembly 100A, that needs to be mounted into, or extracted from, the tray 35, the tray 35 does not need to be pulled out of the apparatus main assembly 100A all the way to the cartridge mounting (dismounting) position E. In other words, the multiple cartridges P in the tray 35 can be sequentially removed from the tray 35, starting from the most downstream one, in terms of the direction in which the tray 35 is pulled out of the apparatus main assembly 100A, as the tray 35 is moved from the tray locking (unlocking) position D to the cartridge mounting (dismounting) position E. That is, it is when the tray 35 is in the cartridge mounting (dismounting) position E that all the cartridges P can be removed from the tray 35.

As described above, the tray 35 is such a member that can be moved in the direction (vertical direction) which is perpendicular (intersectional) to the direction of the axial line of the drum 1 of each cartridge P in the tray 35 (lengthwise direction of cartridge P). That is, the direction in which the tray 35 is moved between the tray locking (unlocking) position D and position E is perpendicular to the lengthwise direction of each cartridge P in the tray 35. In other words, the multiple cartridges P are mountable in the tray 35 in such a manner that they align in parallel (tandem) in the direction in which the tray 35 is moved between the tray locking (unlocking) position D and position E.

Further, the tray 35 in which the cartridges P are placed to be moved into, or extracted from, the apparatus main assembly 100A can be placed in the image formation position (most inward position) C, tray locking (unlocking) position D, and cartridge mounting (dismounting) position E.

The image formation position (most inward position) C for the tray 35 is in the apparatus main assembly 100A. It is such a position that as the tray 35 is moved into the image formation position C, it places each cartridge P in the tray 35 in the image formation position for the cartridge P (FIG. 2).

The cartridge mounting (dismounting) position E for the tray 35 is such a position for the tray 35 that when the tray 35 is in the cartridge mounting (dismounting) position E, it is protruding from the apparatus main assembly 100A, through the opening 30, as far as it is allowed to protrude, to enable the cartridges P to be mounted into, or removed from, the tray 35 (FIGS. 5 and 6).

The tray locking (unlocking) position D for the tray 35 is in the tray path between the cartridge mounting (dismounting) position E and image formation position C. It is the tray position from which the tray 35 is moved to the image formation position C by the pivotal movement of the door 31 from its open position B to the closed position A (FIG. 4).

The left and right tray holding members 34L and 4R make up the means for upwardly moving the tray 35 from the image formation position C to the tray locking (unlocking) position D before the tray 35 can be moved to the cartridge mounting (dismounting) position E which allows the cartridges P to be removed from, or placed in, the tray 35.

In other words, the tray holding members 34L and 34R are supporting members for supporting the tray 35. They can be placed in the first position which allows the tray 35 to be moved between the cartridge mounting (dismounting) position E and tray locking (unlocking) position D, and the second position which places the tray 35 in the image formation position C. More specifically, as the door 31 is moved from its open position B to its closed position A, that is, as the door 31 is closed, the tray holding members 34L and 34R are moved from their first position to their second position by the movement of the door 31. Further, as the door 31 is opened, that is, the door 31 is moved from its closed position A to the open position B, the tray holding members 34L and 34R are moved from their second position to their first position by the movement of the door 31.

<<Cartridge>>

Figure 7:
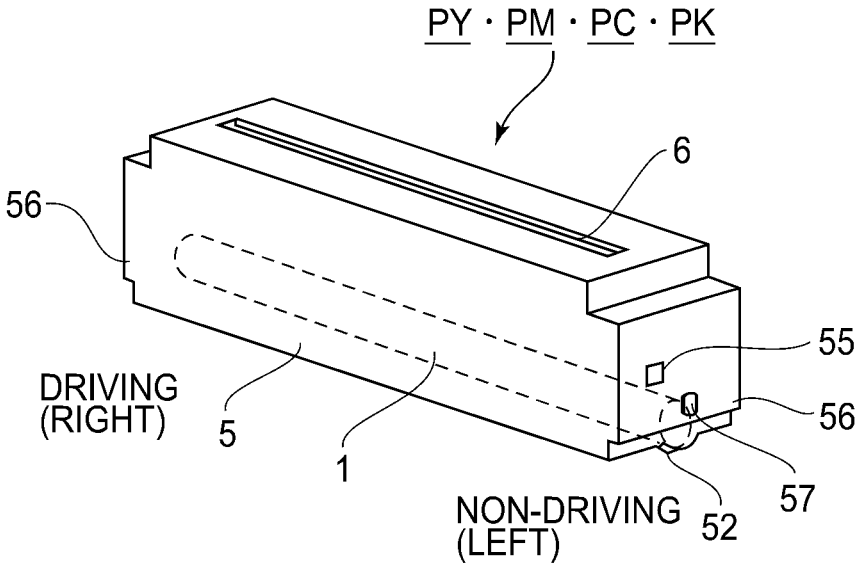
FIG. 7 is a perspective view of the cartridge in the first embodiment, as seen from the side from which it is not driven (no-driving side, hereafter).
Figure 8:
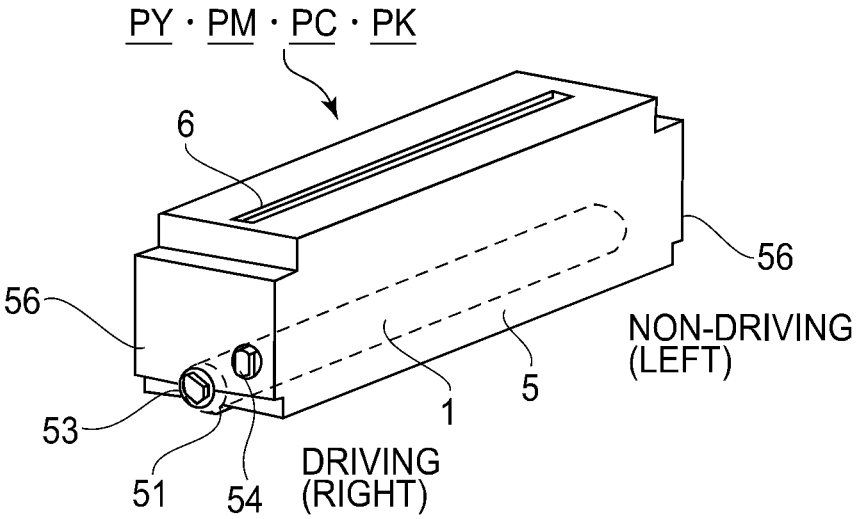
FIG. 8 is a perspective view of the cartridge in the first embodiment, as seen from the side from which it is driven (driving side, hereafter).

FIGS. 7 and 8 are external perspective views of one of the cartridges P. More specifically, FIG. 7 is an external perspective view of the cartridge P as seen from the no-driving side, whereas FIG. 8 is an external perspective view of the cartridge P as seen from the driving side.

Each cartridge P is an assembly of various components. Its left-right direction is the same as the direction of axial line of the drum 1 in the cartridge P. It is in the form of a rectangular parallelepiped, and its lengthwise direction also is the same as the lengthwise direction of the axial line of the drum 1. The drum 1 is rotatably supported between the left and right walls of the cartridge frame 5, by the bearings 51 and 52, which are attached to the left and right walls. The right bearing 51 is provided with a coupling (driving force transmitting portion)

53 as the component through which drum driving force is inputted into the cartridge P. The right wall of the cartridge frame 5 is provided with a coupling (driving force transmitting portion) 54 as the components through which the force for driving the development roller 3*a* is inputted into the cartridge P.

The left wall of the cartridge frame 5 is provided with a protrusion 57 for positioning the cartridge P in terms of the left-right direction, and the electrical contact (electric power supplying contact) 55. Further, the left and right walls of the cartridge frame 5 are provided with a pair of eaves-like protrusions 56, which protrude in the left-right direction from the outward surface of the left and right wall of the cartridge frame 5. The top wall of the cartridge frame 5 is provided with the exposure window 6, which extends in the lengthwise direction of the cartridge P.

Regarding the cartridge P, the lengthwise right end, which is provided with the couplings 53 and 54 is the driving side, and the lengthwise left end, or the opposite end of the cartridge P from the lengthwise right end, which is provided with the electrical contact 55, is the no-driving end. That is, when the cartridge P is properly positioned in the tray 35, its couplings 53 and 54 are at one (right end) of the lengthwise ends, in terms of the direction perpendicular to the direction in which the tray 35 is moved between the cartridge mounting (dismounting) position E and tray locking (unlocking) position D, and the electric power supply contact 55 is at the opposite end of the cartridge P from the couplings 53 and 54.

<<Tray>>

Figure 9:
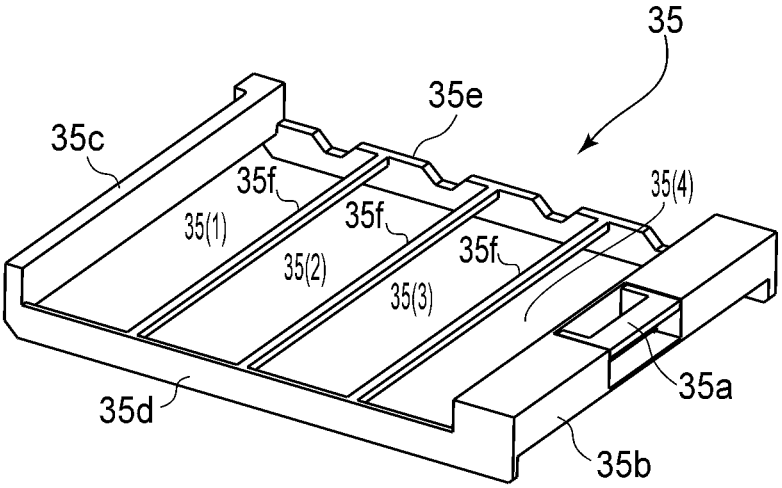
FIG. 9 is a perspective view of the cartridge tray.

FIG. 9 is an external perspective view of the tray 35. The tray 35 has a rectangular main frame, which has four compartments created by equally separating the internal space of the main frame with three partitioning plates 35*f*, in terms of the front-rear direction. Hereafter, the four compartments will be referred to as the first to fourth compartment 35(1)-35(4), listing from the rear wall 35*c* of the main frame toward the front wall 35*b*. It is in these first to fourth compartments 35(1)-35(4) of the main frame of the tray 35 that the first to fourth cartridges PY, PM, PC and PK are held, respectively.

Each cartridge P is inserted into the corresponding compartment of the tray 35 from above. As the cartridge P is inserted into the tray 35, the bottom surface of the left and right protrusions of the cartridge P is caught by the top surface of the left and right sub-frame 35*d* and 35*e*. Consequently, the cartridge P is supported by the tray 35. That is, the tray 35 supports each cartridge P in such a manner that the cartridge P can be moved out of the tray 35 by being moved straight upward, and also, that the cartridge P can be supported by the tray 35 by being moved straight downward into the tray 35 from above. Incidentally, the tray 35 loosely supports each cartridge P. Because the tray 35 and cartridge P are structured as described above, the cartridge P in the tray 35 can be easily replaced.

The bottom surface of the left and right sub-frames 35*d* and 35*e* are rested on the top surface of the left and right tray holding members 34L and 34R, respectively, being thereby supported by the left and right tray holding members 34L and 34R. That is, the tray 35 is supported between the left and right sub-frames (plates) 80L and 80R, and is allowed to horizontally slide on the top surface of the tray holding members 34L and 34R in the front-rear direction; the tray 35 can move relative to the tray holding members 34L and 34R in the front-rear direction.

Referring to FIGS. 5 and 6, if any of the cartridges P held in the tray 35 needs to be replaced, it can be replaced by pulling the tray 35 out of the apparatus main assembly 100A to the cartridge mounting (dismounting) position E. After the replacement of the cartridge P, the tray 35 is to be pushed back all the way into the apparatus main assembly 100A so that the tray 35 is placed where it was before it was pulled out, as shown in FIGS. 3 and 4. As the tray 35 is pushed back all the way into the apparatus main assembly 100A by a user, it is pressed by a spring (pressing means) 103 (FIG. 15) in the rear-to-front direction. Thus, the user is ensured that the tray 35 was pushed into the apparatus main assembly 100A deep enough for the tray 35 to be locked into its preset position. This structural arrangement will be described later.

As the tray 35 is pushed back into the apparatus main assembly 100A deep enough to be locked into its preset position, the tray locking latch (movement regulating means) 101 of the tray 35 engages with the catch (latch engaging portion of apparatus main assembly 100A) 102 (FIG. 15(*b*)→15(*a*)). That is, the tray 35 is pushed back from the cartridge mounting (dismounting) position E to the tray locking (unlocking) position D in the apparatus main assembly 100A, and is held in the tray locking (unlocking) position D.

Then, the user is to close the door 31 (which is open) as shown in FIGS. 1 and 2. As the door 31 is closed, the image forming apparatus 100 becomes ready for an image forming operation. More concretely, as the door 31 is pivotally moved from the exposing position B to the covering position A, the tray holding members 34L and 34R are moved rearward by the preset amount, and also, downward by the preset amount, by the movement of the door 31, whereby the tray 35 is moved from the tray locking (unlocking) position D to the image formation position C. Consequently, each cartridge P held by the tray 35 is placed in its designated position in the cartridge chamber 100B in the apparatus main assembly 100A.

Further, the driving force output portions 39 and 40 of the apparatus main assembly 100A are made to engage with the driving force input portions 53 and 54 of the corresponding cartridge P, by the pivotal closing movement of the door 31. During this engagement, each cartridge P comes under the pressure generated by the driving force outputting portions 39 and 40. Thus, it is moved toward its no-driving side (leftward). Consequently, the protrusion 57 of the cartridge P, which is for positioning the cartridge P in terms of the left-right direction, comes into contact with the left sub-frame (plate) 80L, precisely positioning thereby the cartridge P relative to the apparatus main assembly 100A in terms of the left-right direction.

Thus, each cartridge P, which is under the pressure from the pressing member 42, is held in its designated position 41 in the apparatus main assembly 100A. Further, the electric power supplying system 75 of the apparatus main assembly 100A comes into contact with the electrical contact 55 of each cartridge P, establishing thereby electrical connection between the apparatus main assembly 100A and cartridge P. The movement of various components of the image forming apparatus 100, which is caused by the pivotal closing movement of the door 31, will be described hereinafter.

<<Linkage Between Door and Tray Holding Member>>

Next, referring to FIGS. 10-12, 17 and 19, the mechanical linkage between the door 31 and tray holding members 34L and 34R, which causes the movement of the door 31 to move the tray holding members 34L and 34R, is described.

Figure 10:
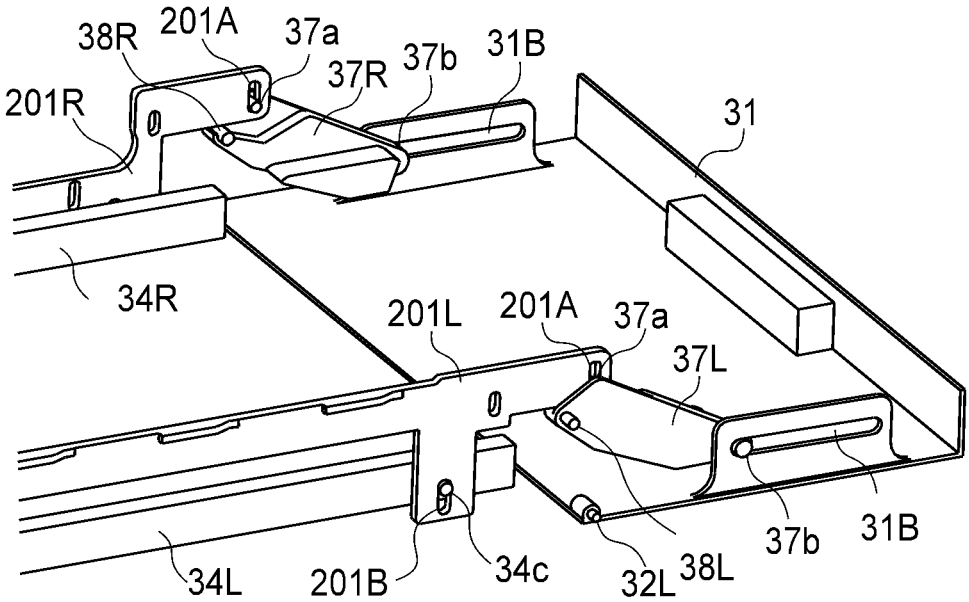
FIG. 10 is a perspective view of the front door and tray holding member of the apparatus, and the mechanism of the apparatus, which is made to move the tray supporting member, by the movement of the front door, and the adjacencies of the mechanism.
Figure 17A:
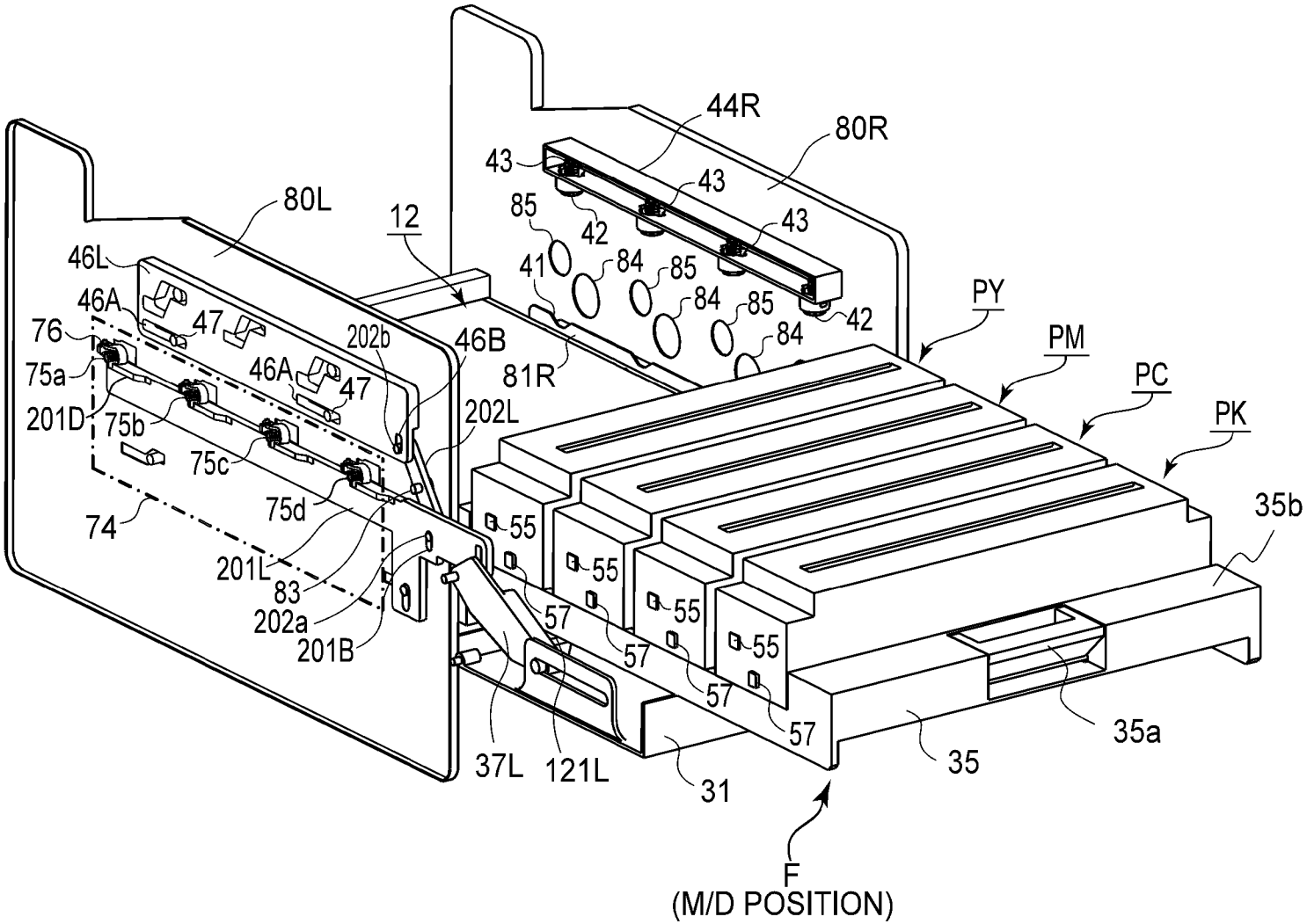
FIG. 17A is a perspective view illustrating the means for supplying the cartridge with electric power.
Figure 17B:
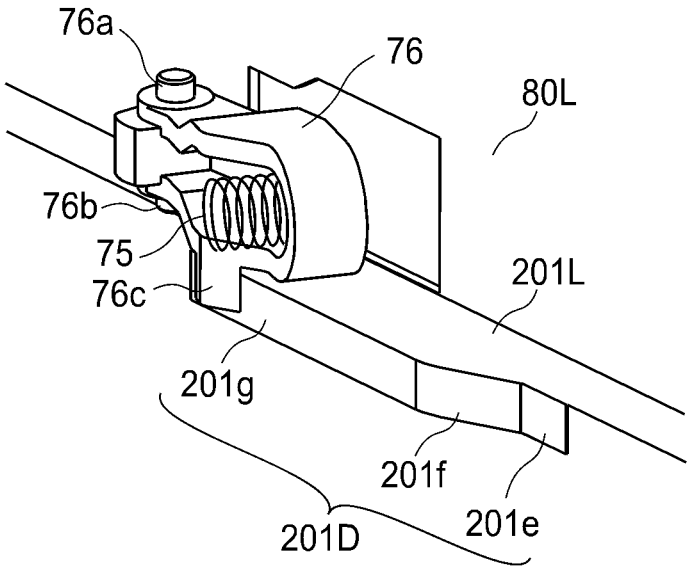
FIG. 17B is an enlarged perspective view of a part of FIG. 17A, illustrating the means for supplying the cartridge with electric power.
Figure 17C:
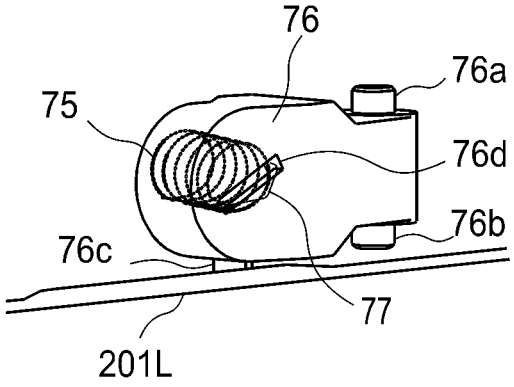
FIG. 17C is a perspective view of a part of FIG. 17B, illustrating the means for supplying the cartridge with electric power.

FIG. 10 is a perspective view of the mechanical linkage between the door 31 and tray holding members 34L and 34R. For convenience's sake, the left and right sub-frames 80L of the apparatus main assembly 100A are not shown in FIG. 10. The hinges 32L and 32R of the door 31 are attached to the apparatus main assembly 100A so that they align with each other in the left-right direction. More concretely, the pin portion of each hinge 32 is rotatably supported by an unshown bearing, with which the corresponding sub-frame 80 of the apparatus main assembly 100A is provided. The bearing may be a part of the frame 80 (FIGS. 17A, 17B and 17C).

The door 31 is provided with a pair of arms 37L and 37R, which are at the ends of the door 31, one for one, in terms of the left-right direction. The arms 37L and 37R are positioned so that their pivot pins 38L and 38R of the arms 37L and 37R, respectively, align in the left-right direction of the apparatus main assembly 100A, and are rotatably supported by unshown bearings, with which the left and right sub-frame 80L and 80R of the apparatus main assembly 100A are provided, one for one. The bearings may be parts of the left and right sub-frames 80L and 80R, one for one.

There are provided a pair (left and right) of connective rods 201L and 201R on the outward side of the left and right sub-frames 80L and 80R (FIGS. 17A, 17B and 17C), respectively, which are positioned so that they extend in the front-rear direction of the apparatus main assembly 100A. The connective rods 201L and 201R are supported by the unshown guiding members (with which the left and right sides of the apparatus main assembly 100A are provided), in such a manner that they are movable only in the front-rear direction.

The connective arms 37L and 37R are provided with shafts 37*a* and 37*b*, which are perpendicular to the arms 37L and 37R, respectively. The shaft 37*a* of the left connective arm 37L is fitted in a vertically elongated hole 201A, with which the front end portion of the left connective rod 201L is provided. The shaft 37*b* is fitted in the groove 31B, with which the left lateral portion of the door 31 is provided. Further, the shaft 37*a* of the right connective arm 37R is fitted in the vertically elongated hole 201A, with which the front end portion of the right connective rode 201R is provided. The shaft 37*b* is fitted in the groove 31B, with which the left lateral portion of the door 31 is provided.

Further, the left and right tray holding members 34L and 34R are provided with a pair of pins (shafts) 34*c* and 34*d*, which are implanted into the tray holding members 34L and 34R, respectively. The pins (shafts) 34*c* and 34*d* are fitted in the guiding holes 36 (FIG. 11) with which the left and right sub-frame 80L and 80R of the apparatus main assembly 100A are provided, respectively. With these pins (shafts) 34*c* and 34*d* being fitted in the guiding holes 36, one for one, the tray holding members 34L and 34R are supported by the left and right sub-frame 80L and 80R, respectively.

The pin (shaft) 34*c* of the left tray holding member 34L is put through the guiding hole 36, and is fitted in the vertically elongated hole 201B, with which the left connective rod 201L is provided. Although the right tray holding member 34R is not shown in FIG. 10, the pin 34*c* of the right tray holding member 34R is put through the guiding hole 36, and is fitted in the vertically elongated hole 201B, with which the right connective rod 201R is provided, connecting thereby the left tray supporting member 34L to the left connective rod 201L.

As described above, the door 31 and tray holding members 34L and 34R are in connection to each other through the connective arms 37L and 37R, and connective rods 201L and 201R. Thus, as the door 31 is opened or closed, the left and right tray holding members 34L and 34R are subjected to such a force that acts in the direction to move them in the front-rear direction. Incidentally, the apparatus main assembly 100A may be structured so that the axial line of the hinge portions 38L and 38R of the connective arms 37L and 37R align with the axial line of the hinge portions 32L and 32R of the door 31. Further, instead of providing the connective arms 37L and 37R, the door 31 may be directly connected to the connective rods 201L and 201R.

Figure 11:
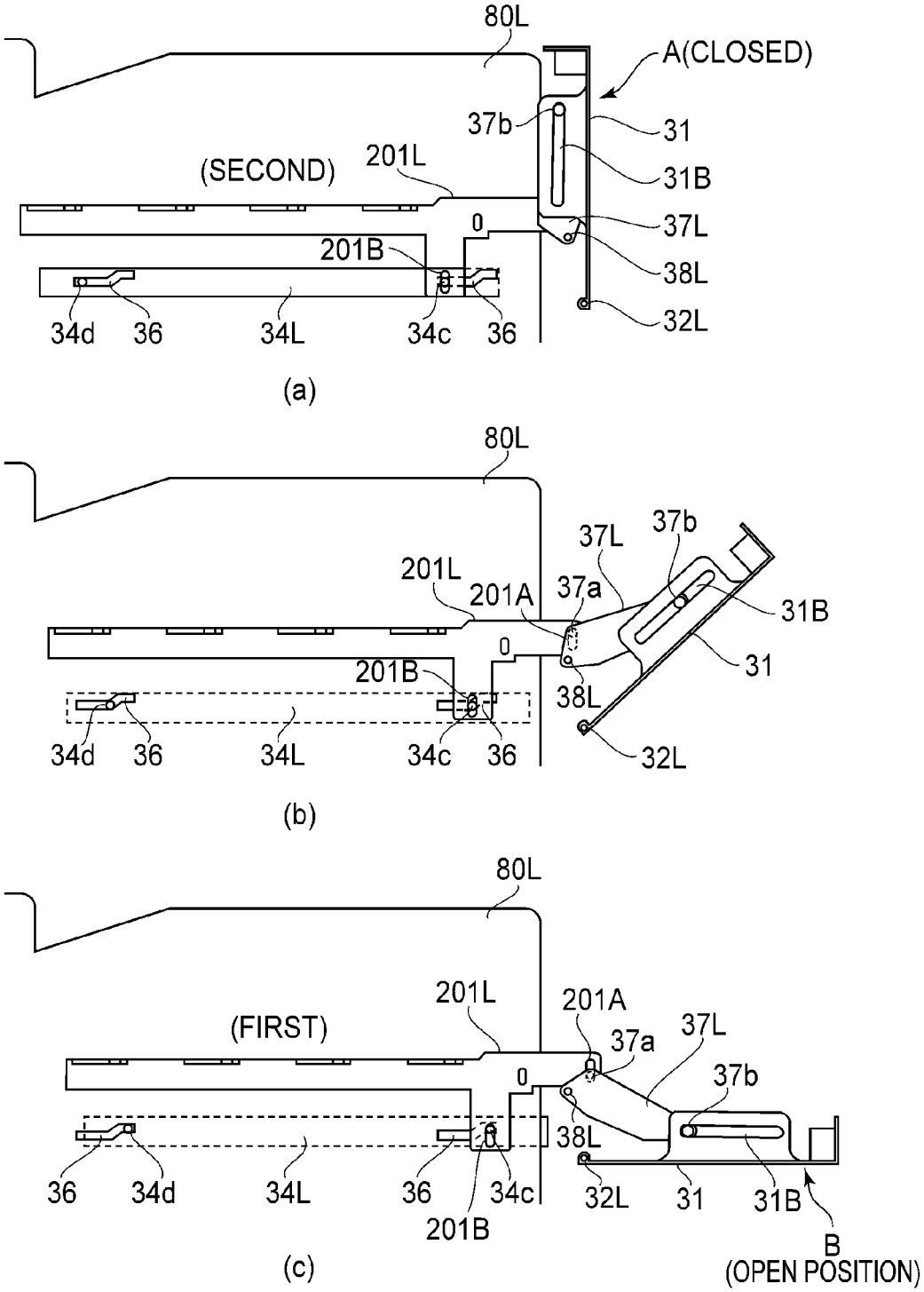
FIG. 11 is a drawing illustrating the movement of the tray holding member of the image forming apparatus, which is caused by the movement of the front door when the door is pivotally opened.

FIG. 11 shows the pair of pins (shafts) 34*c* and 34*d*, with which the left tray holding member 34L is provided, and the guiding holes 36 with which the left sub-frame 80L is provided. Although the right tray holding member 34R is not shown in FIG. 10, it is the same as the left tray holding member 34R. That is, the apparatus main assembly 100A is structured so that the pins (shafts) 34*c* and 34*d* of the tray holding right member 34R, and the corresponding guiding holes 36, are symmetrical in shape and positioned with those of the tray holding left member 34L, and corresponding holes 36.

Therefore, the left and right tray holding members 34L and 34R are afforded a certain amount of latitude in terms of their movement relative to the left and right sub-frames 80L and 80R, within the guiding range of the guiding holes 36.

Figure 12:
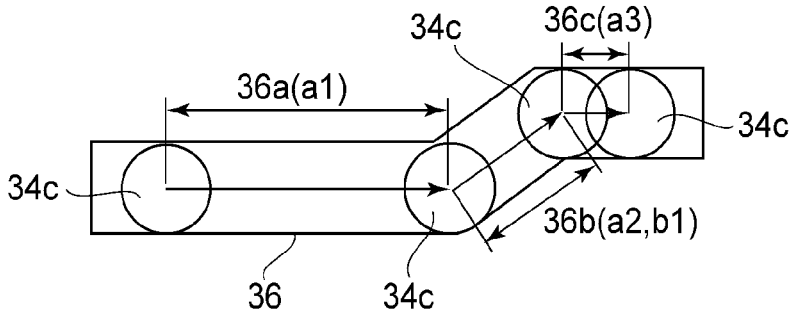
FIG. 12 is an enlarged view of the tray guiding hole of the tray holding member.

FIG. 12 is an enlarged view of the guiding holes 36 and their adjacencies. Each guiding hole 36 has the first, second and third guiding ranges 36*a*, 36*b* and 36*c*, respectively. The first guiding range 36*a* extends in the front-rear direction. The second guiding range 36*b* is in connection to the first guiding range 36*a*, and diagonally extends upward from the front end of the first guiding range 36*a*, in the direction in which the pin (shaft) 34*c* moves relative to the left tray holding member 34L as the door 31 is pivotally is moved. The third guiding range 36*c* is in connection to the top end of the second guiding range 36*b*. It catches the pins (shafts) 34*c* and 34*d*, and securely holds them.

As the door 31 is pivotally opened, the pins (shafts) 34*c* and 34*d* of the tray holding left and right members 34L and 34R, respectively, are moved by the movement of the door 31 as will be described hereinafter. Therefore, the tray holding left and right members 34L and 34R are also moved by the movement of the door 31 as will be described later. That is, first, they are horizontally moved by the first guiding range 36*a*, by a distance a1. Then, they are moved diagonally upward (by distance a2, in horizontal direction, and distance b1, in vertical direction) by the second guiding range 36*b*. Finally, they are horizontally moved by a distance a3, by the third guiding range 36*c*.

FIG. 11(*a*) is a schematic side view of the image forming apparatus 100 when the door 31 is in its closed position A, that is, when the door 31 is completely shut against the apparatus main assembly 100A (opening 30). When the image forming apparatus 100 is in the state shown in FIG. 11(*a*), the tray holding left and right members 34L and 34R are in the rear end portion of the apparatus main assembly 100A, into which they were moved by the combination of the connective arms 37L and 37R, and connective rods 201L and 201R. The pins (shafts) 34*c* and 34*d* are in the rear end portion of the first guiding range 36*a* of the corresponding guiding holes 36, respectively.

Therefore, the tray holding left and right members 34L and 34R are in the bottom position (second position), relative to the left and right sub-frames 80L and 80R. Therefore, the tray 35 held by the tray holding members 34L and 34R is also in the preset bottom position, that is, its image formation position C (FIG. 2).

When the tray 35 is in its image formation position C, each of the cartridges PY, PM, PC and PK is also in its designated position in the cartridge chamber 100B, in which it can contribute to an image forming operation. Further, the top portion of the left end portion of each cartridge P, and the top portion of the right end portion of each cartridge P, are under the downward pressure generated by the pressing members 42. Therefore, the bottom surface of the bearing 51 on the driving side, and the bottom surface of the bearing 52 on the no-driving side, are pressed upon the cartridge positioning portions 41 (FIGS. 13 and 17) with which the cartridge positioning left and right members 81L and 81R of the apparatus main assembly 100A, being thereby fixed to the cartridge positioning members 81L and 81R. Thus, each cartridge P is kept accurately positioned relative to the apparatus main assembly 100A; it is kept in its image formation position in the apparatus main assembly 100A.

Thus, it is ensured that when the cartridge holding left and right members 34L and 34R (hence, cartridges P in tray 35 held by members 34L and 34R) are in the above-described state, the downwardly facing portion of the peripheral surface of the drum 1 in each cartridge P remains in contact with the top surface of the portion of the belt 13 of the belt unit 12, which corresponds in position to the top portion of the loop (belt loop) which the belt 13 forms.

Further, the coupling portions 53 and 54 of each cartridge P are in engagement with the drum driving coupling 39 and development roller driving coupling 40 of the apparatus main assembly 100A, respectively. Further, the electrical contact 55 of each cartridge P can be supplied with electric power by the apparatus main assembly 100A.

The right rear side of the tray 35 is under the pressure generated by the spring 103 (FIG. 15) in the front-to-rear direction, and the tray locking latch 101 is in the catch 102, with which the right sub-frame 80R of the apparatus main assembly 100A is provided. Therefore, it is ensured that the tray 35 is kept in the preset position in the apparatus main assembly 100A.

FIG. 11(*b*) is a side view of the image forming apparatus 100 when the door 31 is half open. As the door 31 is opened when it is in the closed state as shown in FIG. 11(*a*), the tray holding left and right members 34L and 34R are pulled frontward by the movement of the door 31, and therefore, they are moved frontward in the apparatus main assembly 100A. Thus, the pins (shafts) 34*c* and 34*d* of the tray holding members 34L and 34R move frontward by the distance a1 while being guided by the first guiding range 36*a* of the guiding hole 36. FIG. 11(*b*) shows the state of the image forming apparatus 100, in which the door 31 has been opened halfway as described above.

While the tray holding members 34L and 34R are moved by the distance a1 as described above, first, the electrical connection between the electrical contact 55 of each cartridge P and the apparatus main assembly 100A is interrupted. Then, each cartridge P becomes disengaged from the corresponding pressing member 42, being thereby freed from the pressure generated by the pressing member 42. Further, the drum driving coupling 39 and development roller driving coupling 40 are disengaged from each cartridge P. Also during this movement of the tray supporting members 34L and 34R, in order to prevent the tray 35 from following the movement of the tray holding members 34L and 34R, the tray locking latch 101 remains in engagement with the catch of the apparatus main assembly 100A, preventing thereby the tray 35 from moving.

As the door 31 is pivotally opened wider, the tray holding members 34L and 34R are moved further frontward in the apparatus main assembly 100A, by the movement of the door 31, while the pins (shafts) 34*c* and 34*d* of the tray supporting members 34L and 34R are guided by the second guiding range 36*b* of the guiding holes 36. Thus, the tray 35 is moved diagonally upward. At this point, the tray locking latch 101 of the tray 35 is in engagement with the catch of the apparatus main assembly 100A. Therefore, it does not occur that the tray 35 is horizontally moved. In other words, the tray 35 follows only the vertical movement of the tray holding members 34L and 34R. Consequently, the drum 1 which each cartridge P has is separated from the belt 13 of the apparatus main assembly 100A.

FIG. 11(C) shows the door 31, when the door 31 is fully open. When the door 31 is in the state shown in FIG. 11(C), the tray holding members 34L and 34R have been moved diagonally upward by the second guiding range 36*b*, and the pins (shafts) 34*c* and 34*d* are in the third guiding range 36*c*, which is horizontal. That is, the tray holding members 34L and 34R are horizontally moved after they are moved diagonally upward.

This structural arrangement is for keeping the cartridges P and tray holding members 34L and 34R stable in position in terms of their height direction, when the cartridge(s) P is replaced after the tray 35 is pulled out of the tray holding members 34L and 34R. It is also for preventing the tray holding members 34L and 34R from returning to where they were.

As described above, the tray holding members 34L and 34R are horizontally moved after they are moved diagonally upward. In other words, they are held in their first position after being moved by a preset distance relative to the left and right sub-frames 80L and 80R. Thus, the tray 35, which is being held by the tray holding members 34L and 34R, is held in its tray locking (unlocking) position D (FIG. 4) after being moved upward by the preset distance relative to the left and right sub-frame 80L and 80R, from its image formation position C (FIG. 2).

As the tray 35 is unlocked when it is in its tray locking (unlocking) position D, it becomes unregulated in terms of its movement in the horizontal direction. Therefore, it can be slid relative to the tray holding members 34L and 34R in the front-rear direction. That is, it is possible for the tray 35 to be slid between the cartridge mounting (dismounting) position E, in which each cartridge P in the tray 35 can be replaced, and the tray locking (unlocking) position D.

While the tray 35 is pulled out from within the apparatus main assembly 100A, the protrusion 57 of each cartridge P, which is for keeping the cartridge P properly positioned in terms of the left-right direction when the cartridge P is in the tray 35, horizontally moves along the inward surface of the left sub-frame 80L. Therefore, the area of the inward surface of the left sub-frame 80L, along which the cartridge positioning protrusion 57 moves, is desired to be flat, that is, free of peaks and valleys. That is, by not placing the holes, with which the left sub-frame 80L needs to be provided, in the area of the sub-frame 80L, along which the cartridge positioning protrusion 57 moves, it is possible to prevent the cartridge positioning protrusion 57 from being scarred and/or shaved, and therefore, it is possible for the tray 35 to be smoothly pulled out. Examples of the holes with which the left sub-frame 80L needs to be provided are the holes through which the springs 75 for the electrical contacts of the apparatus main assembly 100A, guiding holes 36 for the tray holding left member 34L, etc.

Figure 19:
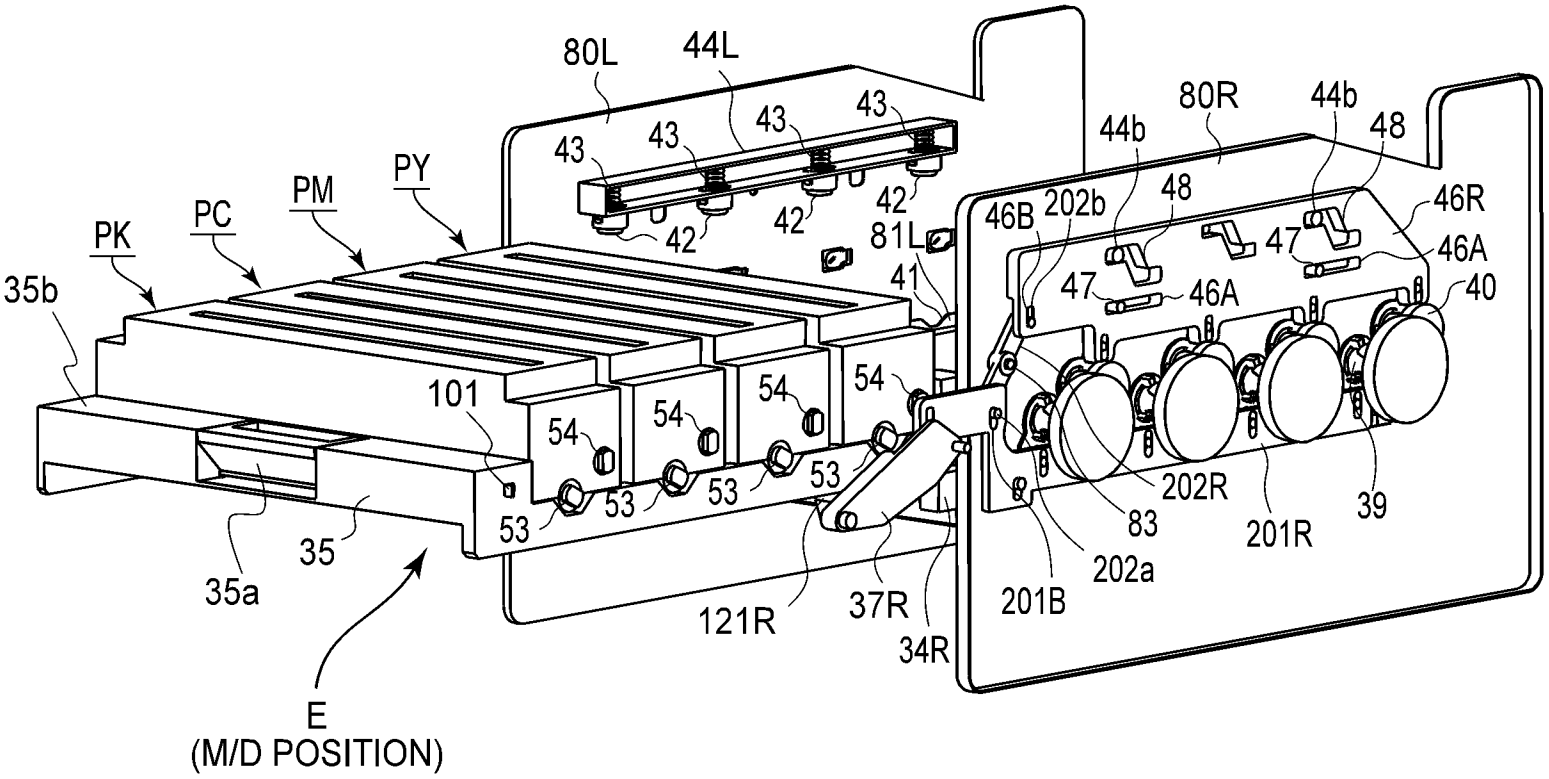
FIG. 19 is a perspective view (1) of the means for pressing, and keeping pressed, the cartridge.

FIGS. 17 and 19 are perspective views of the combination of the sub-frames 80L and 80R, tray 35, process cartridges P, and the components closely related thereto, when the tray 35 is in the cartridge mounting (dismounting) position E, in which all the cartridges P can be replaced. When the tray 35 is in the position shown in FIGS. 17 and 19, the tray 35, which is protruding from the apparatus main assembly 100A as far as it is allowed, is supported by the tray supporting portions 121L and 121R of the connective arms 37L and 37R, respectively. Thus, it is possible to prevent the problem that the portion of the tray 35, which is next to the front of the apparatus main assembly 100A, is bent downward by the weight of the tray 35 itself and the weight of the cartridges P, seriously enough to scar the peripheral surface of the drum 1, and/or the weight of the tray 35 itself and the weight of the cartridges P unbalance the apparatus main assembly 100A seriously enough to tip the apparatus main assembly 100A frontward.

The connective arms 37L and 37R are rotationally moved by the movement of the door 31. Therefore, it is possible to place the supporting portions 121L and 121R of the connective arms 37L and 37R, respectively, in such a manner that when the door 31 is closed, they will be inside the apparatus main assembly 100A, whereas when the door 31 is opened, they will be outside the apparatus main assembly 100A. Thus, it is possible to improve the image forming apparatus in the usability related to the cartridge replacement operation, by being enabled to securely hold the tray 35 in its loading (unloading) position E, without increasing the apparatus main assembly 100A in size.

Figure 18:
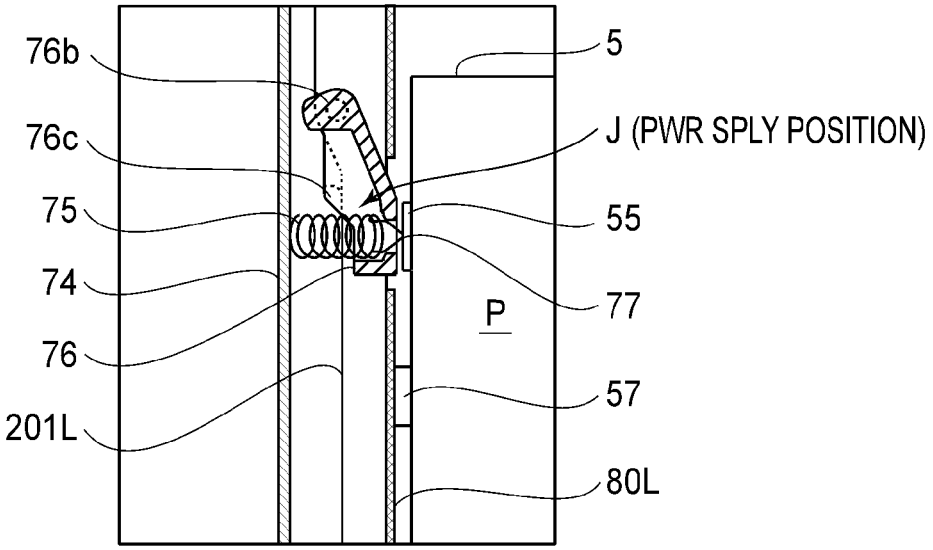
FIG. 18 is a drawing (2) illustrating the means for supplying the cartridge with electric power.
Figure 18:
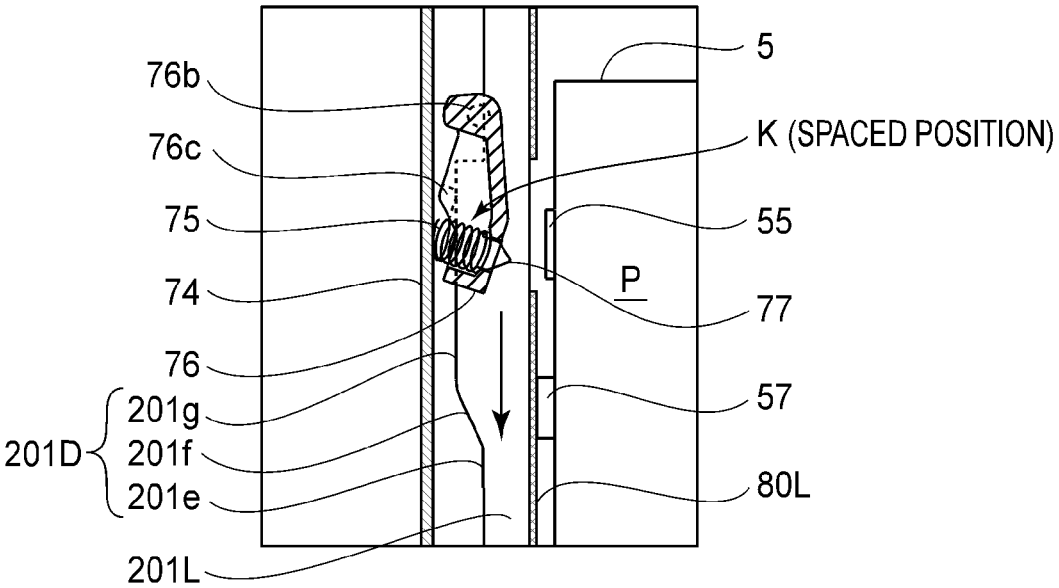

Regarding the shape and number of supporting points, the supporting portions 121L and 121R which support the tray 35 in the cartridge mounting (dismounting) position E, do not need to be as shown in FIGS. 17 and 18. Further, the tray supporting portions (portions which support tray 35 after tray 35 is pulled out) may be constructed as integral parts of the door 31.

<<Tray Position Regulating Means>>

Next, referring to FIGS. 13-16, and 26, the means for regulating the tray 35 in position is described.

Figure 13:
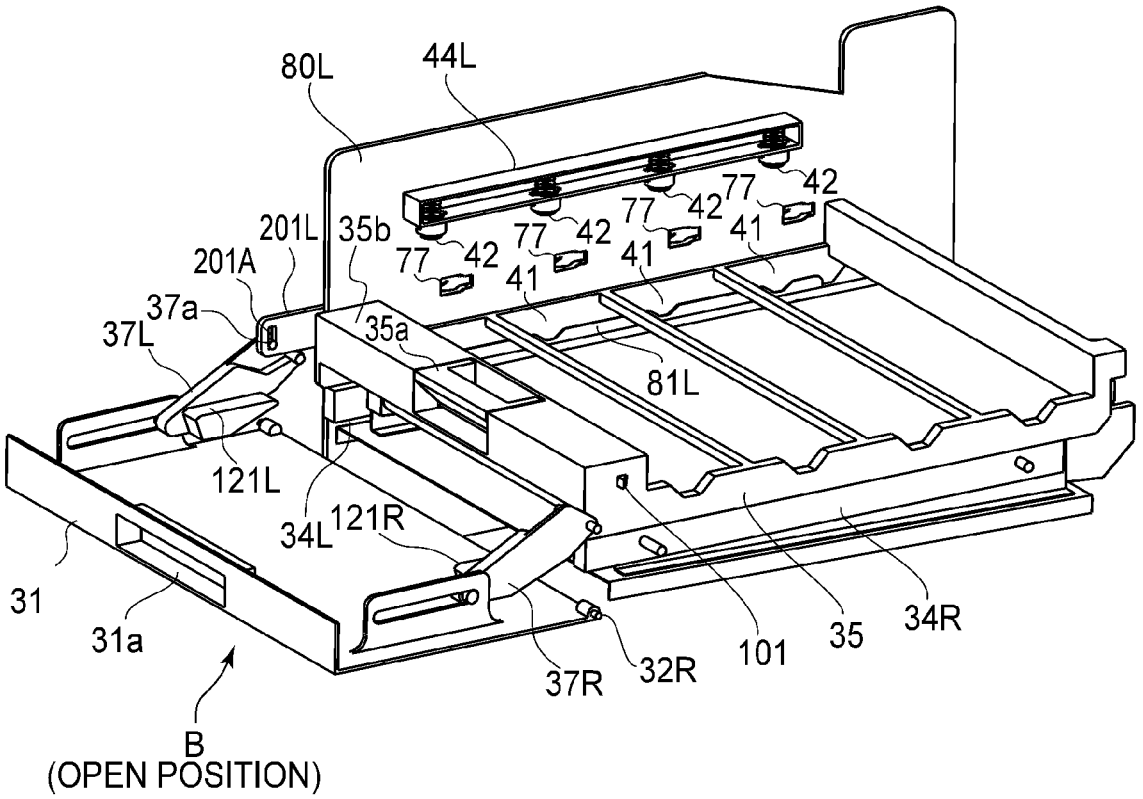
FIG. 13 is a perspective view (1) of the tray position regulating means.
Figure 14:
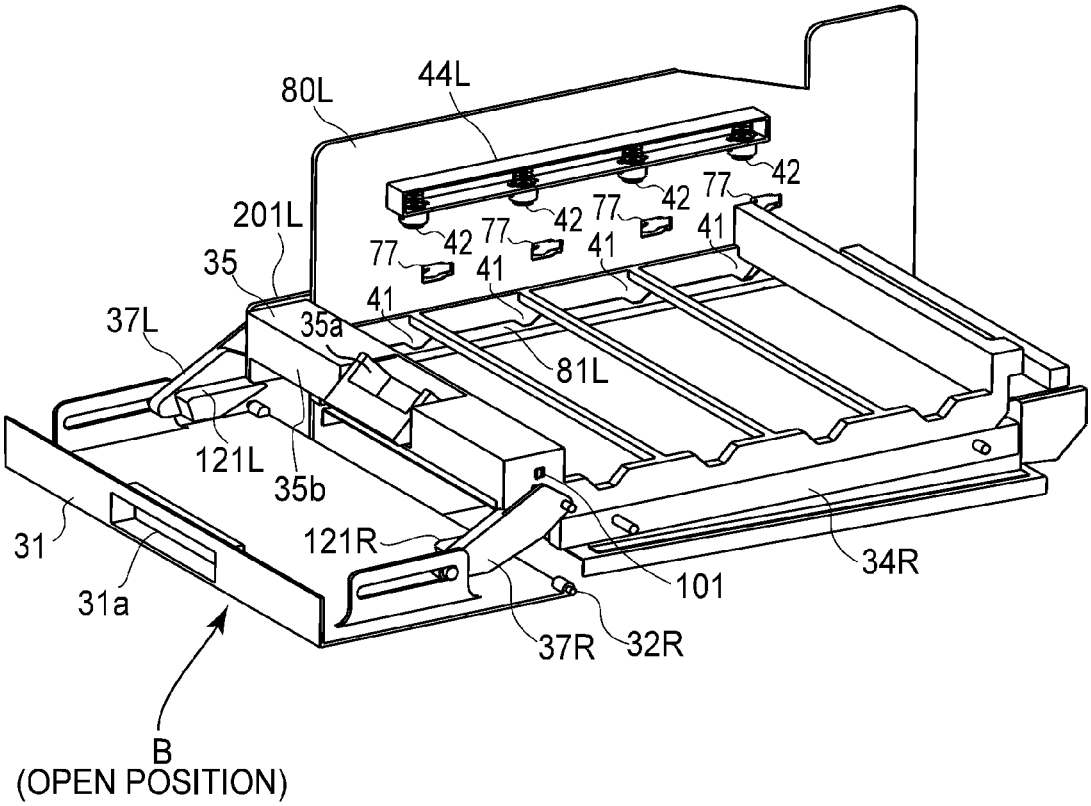
FIG. 14 is a perspective view (2) of the tray position regulating means.

FIG. 13 is a perspective view of the combination of the left sub-frame 80L, door 31, and tray 35, when the tray 35 is entirely in the apparatus main assembly 100A, more specifically, after it was moved from the cartridge mounting (dismounting) position E, which is outside the apparatus main assembly 100A, to the tray locking (unlocking) position D (FIG. 4), which is inside the apparatus main assembly 100A. FIG. 14 is perspective view of the combination of the left sub-frame 80L, door 31, and tray 35, when the tray 35 is almost entirely in the apparatus main assembly 100A; it has not reached the tray locking (unlocking) position D. FIG. 15 is a drawing illustrating the movement of the tray movement regulating means for guiding the tray 35 to the tray locking (unlocking) position D toward the end of the inward movement of the tray 35 into the apparatus main assembly 100A.

Figure 16:
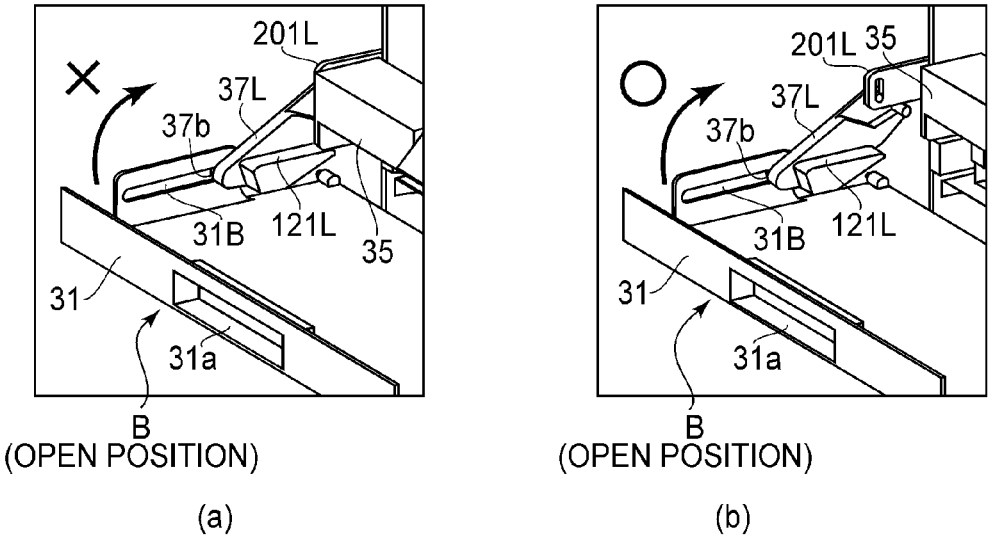
FIG. 16 is a perspective view (4) of the tray position regulating means.

When the tray 35 is in the state shown in FIG. 14, that is, when the tray 35 has been almost entirely pushed into the apparatus main assembly 100A, the supporting portions 121L and 121R of the connective arms 37L and 37R, respectively, have just come into contact with the bottom surface of the tray 35, as shown in FIG. 16(*a*), while the connective arms 37L and 37R are rotationally moved by the pivotal closing movement of the door 31. Thus, it is impossible to close the door 31 to move the tray holding members 34L and 34R rearward, and then, move them diagonally downward.

In comparison, when the tray 35 is in the state shown in FIG. 13, that is, after the tray 35 has been entirely pushed into the apparatus main assembly 100A, the supporting portions 121L and 121R of the connective arms 37L and 37R, respectively, do not interfere with the tray 35, as shown in FIG. 16(*b*), while the connective arms 37L and 37R are rotationally moved by the pivotal opening movement of the door 31. Therefore, it is possible for the door 31 to be closed to lower the tray holding members 34L and 34R (hence, the tray 35).

Referring to FIG. 15, the tray 35 is under the pressure applied to the tray 35 from the rear side of the tray 35 by the spring 103 through the pressing member 104. Therefore, if a user fails to push the tray 35 all the way into the apparatus main assembly 100A, the tray 35 is pushed back by the aforementioned pressure by a distance which is proportional to the length by which the spring 103 is compressed by the inward movement of the tray 35, as shown in FIG. 15(*b*). After the tray 35 is pushed back, the position of the tray 35 is as shown in FIGS. 14 and 16(*a*).

That is, if the user erroneously tries to close the door 31, that is, without moving the tray 35 into the tray locking (unlocking) position D, the supporting portions 121L and 121R of the connective arms 37L and 37R surely interfere with the tray 35, prompting the user to correct the error. In comparison, as the tray 35 is put in the position shown in FIGS. 13 and 16(*a*), that is, as the tray 35 is pushed far enough into the apparatus main assembly 100A so that it is put in the tray locking (unlocking) position D, the tray locking latch 101 engages with the latch catching means 102 of the apparatus main assembly 100A. Thus, the tray 35 remains properly positioned relative to the apparatus main assembly 100A as shown in FIG. 15(*a*).

Figure 26:
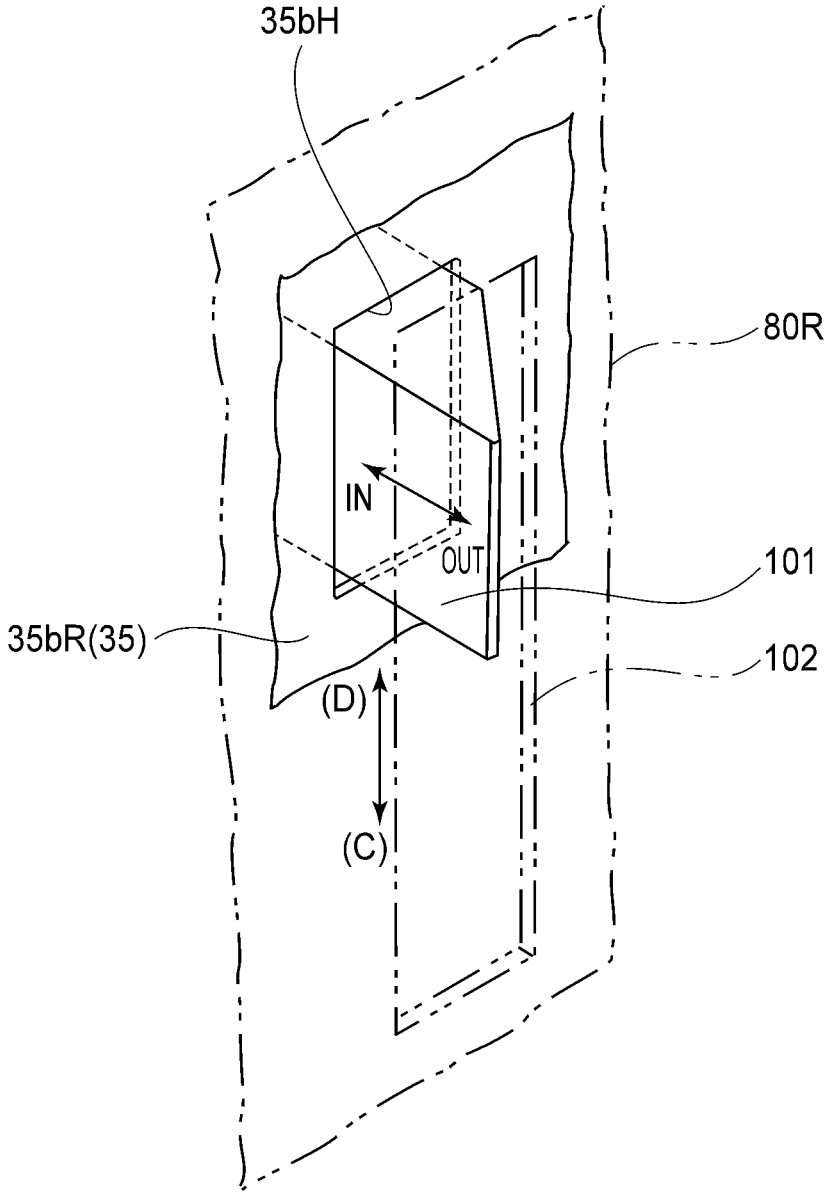
FIG. 26 is a perspective view of the latch of the cartridge, and the catch of the main assembly of the image forming apparatus.

FIG. 26 shows the shape of the tray locking latch 101, and the shape of the latch catching means 102 of the apparatus main assembly 100A. The tray locking latch 101 is such a member that is made to protrude or retract through the hole 35*b*H, with which the right side 35*b*R of the front piece 35*b* of the frame of the tray 35 is provided, by the movement of the movable handhold 35*a* of the tray 35. The tray locking latch 101 is made to protrude into the hole 35*b*H of the frame of the tray 35, by an unshown pressing means, and is kept in the hole 35*b*H. However, as the handhold 35*a* is pulled frontward, the tray locking latch 101 is pulled back into the tray 35 through the hole 35*b*H by the movement of the handhold 35*a*.

The latch catching means 102 of the apparatus main assembly 100A is a vertically elongated hole with which the right sub-frame 80R of the apparatus main assembly 100A is provided. As the tray locking latch 101 of the tray 35 is made to protrude through the hole 35*b*H, and fits into the elongated hole 102 as the latch catching means of the apparatus main assembly 100A, the tray 35 is kept in the tray locking (unlocking) position D, whereas as the tray locking latch 101 is retracted into the tray 35 through the hole 35*b*H, it comes out of the elongated hole 101; it disengages from the right sub-frame 80R of the apparatus main assembly 100A.

The latch catching means 102 of the apparatus main assembly 100A is a vertically elongated hole. Therefore, the tray 35 is allowed to be moved from the tray locking (unlocking) position D to the image formation position C, or from the image formation position C to the tray locking (unlocking) position D, while the tray locking latch 101 is remaining in engagement with the latch catching means 101 of the apparatus main assembly 100A.

When the tray 35 is in the tray locking (unlocking) position D, the tray locking latch 101 is in engagement with the latch catching means 102 of the apparatus main assembly 100A. Therefore, the tray 35 is locked in the tray locking (unlocking) position D, being thereby prevented from moving.

As the handhold 35*a* is pulled frontward when the tray 35 is in the tray locking (unlocking) position D, the tray locking latch 101 is retracted into the tray 35 by the movement of the handhold 35*a*, being thereby disengaged from the latch catching means of the apparatus main assembly 100A. In other words, the tray 35 is freed (unlocked) from the apparatus main assembly 100, in terms of its frontward movement. Consequently, the tray 35 is made to slightly protrude from the front side of the apparatus main assembly 100A, by the pressure applied to the tray 35 by the spring 103 through the pressing means 104. Thus, the user can slide the tray 35 into the cartridge mounting (dismounting) position E, by pulling the tray 35 by the handhold 35*a*.

On the other hand, as the tray 35 is pushed into the apparatus main assembly 100A from the cartridge mounting (dismounting) position E, the rear piece 35*c* of the tray frame comes into contact with the pressing member 104 slightly before the tray 35 reaches the tray locking (unlocking) position D. Then, as the tray 35 is pushed further into the apparatus main assembly 100A against the pressure applied to the tray 35 by the spring 103 through the pressing member 104, the tray locking latch 101 is caught by the latch catching means 101 of the apparatus main assembly 100A the moment the tray 35 reaches the tray locking (unlocking) position D. Thus, the tray 35 is locked in the tray locking (unlocking) position D, being thereby regulated in movement.

Incidentally, the shape and number of the tray locking latch 101 of the tray 35, and those of the latch catching means of the apparatus main assembly 100A, do not need to be as shown in FIGS. 15 and 26. Further, the shape and number of the tray pressing means 103, and those of the tray pressing member and 104, do not need to be as shown in FIG. 15.

<<Interface>>

Next, the structure of the interface between each cartridge P and image forming apparatus, more specifically, the structural arrangement for supplying each cartridge with electric power, structural arrangement for keeping each cartridge P pressed upon the apparatus main assembly A, and structure of the coupling through which driving force is transmitted from the apparatus main assembly 100A to each cartridge P, are described.

(Structural Arrangement for Supplying Cartridge with Electric Power)

FIGS. 17 and 18 are drawings illustrating the method for supplying each cartridge P with the electric power from the apparatus main assembly 100A. There are disposed springy electrical contacts as electric power supplying members (electrical contact unit) 75 (75*a*, 75*b*, 75*c* and 75*d*) for supplying the electrical contacts of each cartridge P with electric power, on the left side (no-driving side) of the apparatus main assembly 100A, more specifically, on the inward surface of the left sub-frame 80L of the apparatus main assembly 100A.

FIG. 17A is a perspective view of the combination of the left and right sub-frames 80L and 80R, tray supporting left member 34L, tray 35, and various components of theirs, when the tray 35 is in the cartridge mounting (dismounting) position E, into which the tray 35 was moved by the opening of the door 31. The cartridges P are supported by the tray 35, being aligned in parallel in the horizontal direction. Each cartridge P is provided with the electrical contact 55, which is on the outward surface of the left wall of the cartridge P, being at a preset position in terms of the vertical direction; the cartridges P are the same in the position of their electrical contact in terms of the vertical direction.

The apparatus main assembly 100A is provided with the springy electrical contacts 75*a*-75*d*, which are electrically in contact with the power supplying portion 75 of the apparatus main assembly 100A, which is on the outward side of the left sub-frame 80L of the apparatus main assembly 100A. The springy electrical contacts 75*a*-75*d* are aligned in the horizontal direction of the apparatus main assembly 100A, and are the same in position in terms of the vertical direction of the apparatus main assembly 100A. FIG. 17B is an enlarged view of one of the springy electrical contacts of the apparatus main assembly 100A, and its adjacencies. FIG. 17C is a perspective view of the springy electrical contact shown in FIG. 17B, as seen from the inward side of the left sub-frame 80L.

One end of each of the springy electrical contacts 75*a*-75*d* of the apparatus main assembly 100A is electrically in contact with the corresponding electric power supplying portion 74 of the apparatus main assembly 100A. The other end is held by the electrical contact holder 76 of the apparatus main assembly 100A, in such a manner that its point 77 of contact protrudes toward the corresponding cartridge P through the hole 76*d*, with which the electric contact holder 76 is provided.

The top and bottom ends of the electrical contact holder 76 of the apparatus main assembly 100A is rotatably held by a pair of unshown bearings, one for one, with which the apparatus main assembly 100A is provided. The electrical contact holder 76 of the apparatus main assembly 100A is under the pressure generated by the springy electrical contact 75 of the apparatus main assembly 100A in a direction to cause the electrical contact holder 76 of the apparatus main assembly 100A to rotate in such a direction that causes its point 77 of contact to come into contact with the corresponding cartridge P. However, the electrical contact holder 76 of the apparatus main assembly 100A is regulated in rotational movement by the combination of the protrusion 76*c* of the electrical contact holder 76, and the surface of the cam portion 201D of the connective rod 201L.

FIGS. 18(*a*) and 18(*b*) are drawings of the electrical contact 55 of one of the cartridges P, and the corresponding electrical contact 75 of the apparatus main assembly 100A, when the two electrical contacts 55 and 75 are electrically in contact with each other, and when they are not in contact with each other, respectively. That is, each drawing is a part of the sectional view of a part of the image forming apparatus 100, which includes the electrical contact 55 of the cartridge P, springy electrical contact 75 of the apparatus main assembly 100A, electrical contact holder 75 of the apparatus main assembly 100A, electric power supplying portion 74 of the apparatus main assembly 100A, and connective rod 201L, at a horizontal plane, as seen from above the apparatus main assembly 100A.

FIG. 18(*a*) shows the state of the abovementioned components after the cartridge P was placed in its preset position for image forming operation, by the descending of the tray 35 to its image formation position C. When these components are in the state shown in FIG. 18(*a*), the point 77 of contact of the springy electrical contact 75 of the apparatus main assembly 100A is protruding toward the cartridge P through the hole, with which the left sub-frame 80L of the apparatus main assembly 100A is provided, and is in contact with the electrical contact 55 of the cartridge P.

That is, when the door 31 is in its closed position A, the springy electrical contact 75 of the apparatus main assembly 100A is in its power supplying position J, that is, the position in which it can supply the electrical contact 55 of the cartridge P with electrical power. In other words, it is electrically in contact with the electrical contact 55 of the cartridge P.

FIG. 18(*b*) shows the state of the abovementioned components after the cartridge P was moved upward from its preset position for image formation, by the ascending of the tray 35 from its image formation position C to its tray locking (unlocking) position D. As the door 31 is pivotally opened, the connective rod 201L is moved frontward of the apparatus main assembly 100A by the pivotal movement of the door 31, whereby the electrical contact holder 76 of the apparatus main assembly 100A is rotated by the surface of the cam portion 201D in the direction to cause the springy electrical contact 75 of the apparatus main assembly 100A to separate from the electrical contact 55 of the cartridge P.

That is, as the door 31 is pivotally moved into its open position B, the springy electrical contact 75 of the apparatus main assembly 100A is moved into its separation position K, in which it does not contact the electrical contact 55 of the cartridge P. That is, the springy electrical contact 75 of the apparatus main assembly 100A is separated from the electrical contact 55 of the cartridge P in terms of electrical connection.

Further, the cartridge electrical contact contacting portion 77 of the springy electrical contact 75 of the apparatus main assembly 100A is retracted outward of the apparatus main assembly 100A through the hole with which the left sub-frame 80L of the apparatus main assembly 100A is provided, enabling thereby the tray 35 to be pulled out of the apparatus main assembly 100A without being placed in contact with the springy electrical contact 75 of the apparatus main assembly 100A.

The surface of the cam portion 201D of the connective rod 201L is made up of portions 201*e* and 201*g* which are parallel to the moving direction of the tray 35, and a portion 201*f* which is slanted relative to the moving direction of the tray 35. Therefore, when the door 31 is completely closed relative to the apparatus main assembly 100A (closed position A), the springy electrical contact 75 of the apparatus main assembly 100A remains in contact with electrical contact 55 of the cartridge P (power supplying position J). On the other hand, when the door is fully open (open position B), the springy electrical contact 75 of the apparatus main assembly 100A remains separated from the electrical contact 55 of the cartridge P (separation position K).

Regarding the amount of the stroke of the springy electrical contact 75 of the apparatus main assembly 100A, which is caused by the rotational movement of each electrical contact holder 76 of the apparatus main assembly 100A, that is, the amount by which the springy electrical contact 75 of the apparatus main assembly 100A is compressed as the electrical contact holder 76 of the apparatus main assembly 100A is rotationally moved from its power supplying position J, in which it is when the door 31 is closed, and contacts the electrical contact 55 of the cartridge P, to its separation position K, in which it is when the door 31 is open, by the rotational movement of the electrical contact holder 76.

That is, the amount of this stroke has to be large enough to ensure that the springy electrical contact 75 of the apparatus main assembly 100A is prevented from coming into contact with the electrical contact 55 of the process cartridge P when the tray 35 is pulled out of the apparatus main assembly 100A, and yet, small enough to ensure that springy electrical contact 75 of the apparatus main assembly 100A remains in contact with the electrical contact 55 of the process cartridge P when the door 31 is closed, even if the dimensional defects of the various components related to the stroke of the springy electrical contact 75 of the apparatus main assembly 100A are in the extreme range of the tolerance. The greater the amount of this stroke, the greater the margin for the dimensional defects of the components, but, the greater the amount of force which has to be applied by a user to compress the springy electrical contact 75 of the apparatus main assembly 100A, that is, the amount of force required of the user to operate the image forming apparatus 100. Therefore, it is important that the amount of the stroke of the springy electrical contact 75 of the apparatus main assembly 100 is reduced as much as possible. In other words, it is important that the components related to the stroke of the springy electrical contact 75 of the apparatus main assembly 100A are positioned relative to each other as accurately as possible.

Regarding the positioning of each cartridge P relative to the apparatus main assembly 100A in this embodiment, in terms of the left-right direction, each cartridge P is positioned by the placement of the positioning protrusion 57 of the cartridge P in contact with the left sub-frame 80L of the apparatus main assembly 100A as described above. Therefore, the shaft portion of the electrical contact spring holder 76 and the connective rod 201L of the apparatus main assembly 100A are also positioned relative to the apparatus main assembly 100A, in terms of the left-right direction, by their placement in contact with the left frame 80L. Therefore, the image forming apparatus 100 in this embodiment is smaller in the amount of nonuniformity in the distance between the electrical contact 55 of the cartridge P and the springy electrical contact 75 of the apparatus main assembly 100A than any image forming apparatus in accordance with the prior art. In other words, the image forming apparatus 100 in this embodiment is less in the amount of the stroke of the springy electrical contact 75 of the apparatus main assembly 100A, being therefore smaller in the amount of force of which a user is required to open or close the door 31, than any image forming apparatus in accordance with the prior art.

FIGS. 17 and 18, which were mentioned above, show the method, in this embodiment, for supplying the cartridges P in the apparatus main assembly 100A with electrical power. This method employs one electrical contact per electrical contact 55 of a process cartridge P. That is, the method requires one springy electrical contact 75 per electrical contact 35 of the process cartridge P, that is, the electrical contact which is to be supplied with electric power. However, even if each cartridge P is provided with multiple electrical contacts, the same method as the one employed in this embodiment is employable. In such a case, the image forming apparatus 100 may be structured so that the multiple springy electrical contacts 75 of the apparatus main assembly 100A are held by the electrical contact holder 76 of the apparatus main assembly 100A, or the apparatus main assembly 100A may be provided with multiple electrical contact holders 75 per cartridge P.

In the case of FIGS. 17 and 18, the image forming apparatus 100 is structured so that the top and bottom end portions 76*a* and 76*b* of the electrical contact holder 76 of the apparatus main assembly 100A are rotatably held by the pair of bearings, one for one, and the springy electrical contact 75 of the apparatus main assembly 100A is placed in contact with, or separated from, the electrical contact 55 of the cartridge P by the pivotal movement of the electrical contact holder 76 of the apparatus main assembly 100A. However, the image forming apparatus 100 may be structured so that the springy electrical contact 75 of the apparatus main assembly 100A is placed in contact with, or separated from, the electrical contact 55 of the cartridge P, by being horizontally moved in the left-right direction of the apparatus main assembly 100A, like the driving force transmitting couplings, which will be described later.

(Structure of Pressing Mechanism)

Referring to FIGS. 13, 14, 17 and 19, the apparatus main assembly 100A is provided with a pair (left and right) of positioning members 81L and 81R, which are on the inward side of the left and right lateral wall of the apparatus main assembly 100A. These left and right positioning members 81L and 81R are provided with cartridge positioning portions (recesses) 41, which also are on the inward side of the left and right lateral wall of the apparatus main assembly 100A. The cartridge positioning portions 41 catch and hold the driving-side bearing 51 and no-driving-side bearing 52 of the cartridges P, by the bottom surface of the bearings 51 and 52. Further, the apparatus main assembly 100A is provided with four pairs of cartridge pressing members 42, which are for pressing on the left and right end portions of the top surface of the cartridges P, one for one, to cause the bearing 51 (on drive side) and bearing 52 (on no-driving side) of each cartridge P, to fit into the cartridge positioning portions (recesses) 41, with which the apparatus main assembly 100A is provided, and keeping the bearings 51 and 52 in the cartridge positioning portions 41.

Figure 20:
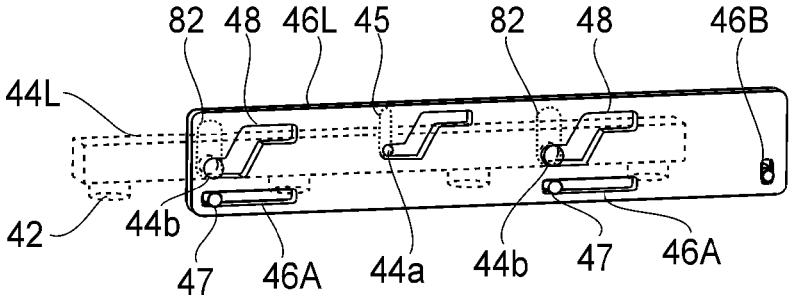
FIG. 20 is a perspective view (2) of the means for pressing, and keeping pressed, the cartridge.
Figure 23:
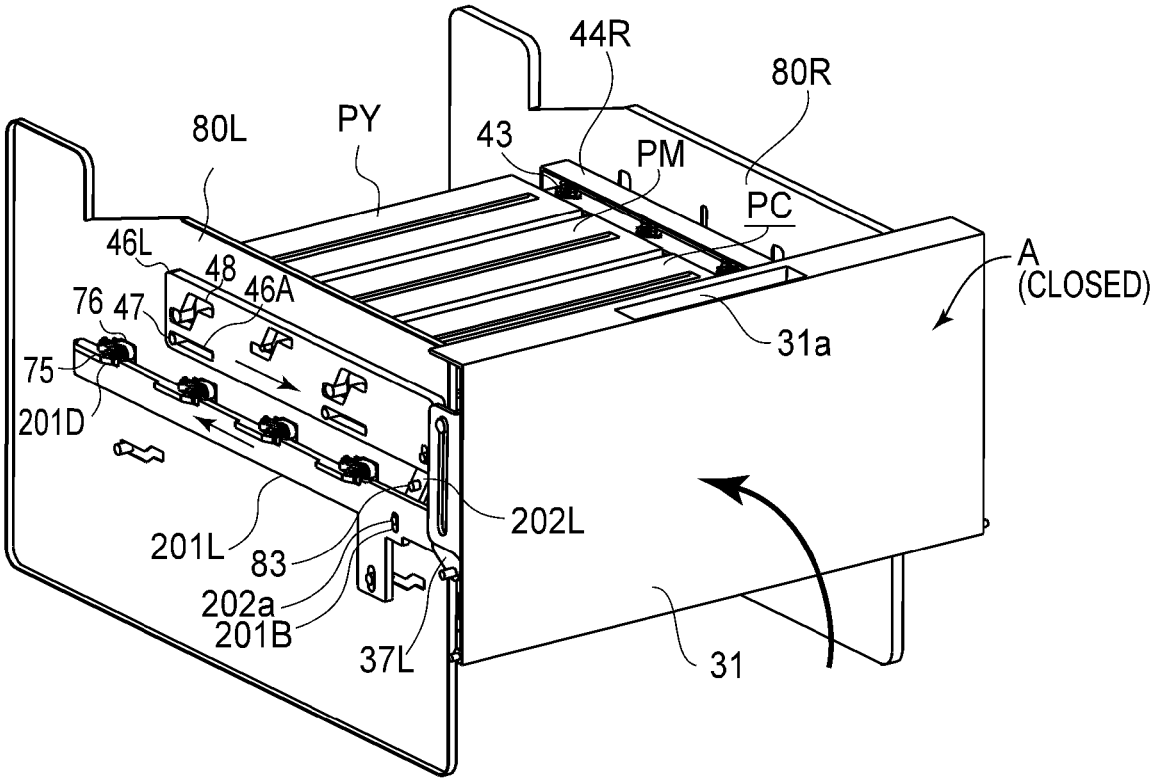
FIG. 23 is a drawing (2) illustrating the means for pressing, and keeping pressed, the cartridge.

FIG. 23 is a perspective view of the portion of the image forming apparatus 100, which is related to the cartridge pressing mechanism of the apparatus 100, as seen from the left side of the apparatus 100, when the door 31 is closed. FIG. 19 is a perspective view of the same portion of the image forming apparatus 100 as the one shown in FIG. 23, as seen from the right side of the apparatus 100, when the tray 31 has been pulled out all the way from the apparatus main assembly 100A as shown in FIGS. 17A, 17B and 17C. FIG. 20 is a perspective view of a part of the cartridge pressing mechanism. It shows the structure of the part of the cartridge pressing mechanism.

Referring to FIGS. 17, 19 and 23, there are disposed a pair of pressing rods 46L and 46R, on the outward side of the left and right sub-frames 80L and 80R, respectively. There are also disposed a pair of linkage rods 202L and 202R for causing the connective rods 201L and 201R to move with the pressing rods 46L and 46R, on the outward side of the left and right sub-frames 80L and 80R, respectively.

The left and right pressing rods 46L and 46R are provided with a pair of elongated horizontal holes 46A, which are positioned a preset distance apart from each other, and in which a pair of pins (shafts) 47, with which each of the left and right frames 80L and 80R is provided, are fitted. With these pins (shafts) 47 fitted in the elongated horizontal holes 46A, the pressing rods 46L and 46R are supported by the left and right sub-frames 80L and 89R, being enabled to be moved relative to the left and right sub-frames 80L and 80R, respectively, in the front-rear direction.

The left and right linkage rods 202L and 202R are supported by a pair of shafts (pivots) 83, with which the left and right sub-frame 80L and 80R are provided, one for one, being enabled to be rotationally moved relative to the left and right sub-frame 80L and 80R, respectively. Each of the linkage rods 202L and 202R is provided with a pair of horizontal shafts 202*a* and 202*b*.

The horizontal shaft 202*a* of the left linkage rod 202L is fitted in the elongated vertical hole 202B, with which the right connective rod 201L is provided, whereas the horizontal shaft 202*b* of the left linkage rod 202L is fitted in the elongated vertical holes 46B, with which the left pressing rod 46L is provided.

Similarly, the horizontal shaft 202*a* of the right linkage rod 202R is fitted in the elongated vertical hole 202B, with which the right connective rod 201R is provided, whereas the horizontal shaft 202*b* of the right linkage rod 202R is fitted in the elongated vertical holes 46B, with which the ride pressing rod 46L is provided.

Therefore, the pressing rods 46L and 46R are enabled to be moved in the front-rear direction by the front-rear movement of the connective rods 201L and 201R, through the linkage rods 202L and 202R, respectively. That is, the pressing rods 46L and 46R are moved in the front-rear direction by the pivotal opening, or closing, movement of the door 31.

As the door 31 is opened, that is, as the door 31 is moved from its closed position (FIG. 13) to its open position (FIGS. 17A, 17B and 17C), the connective rods 201L and 201R are moved frontward of the apparatus main assembly 100A, by the movement of the door 31, whereas the pressing rods 46L and 46R are moved rearward of the apparatus main assembly 100A by the movement of the door 31, through the linkage rods 202L and 202R, respectively. On the other hand, as the door 31 is closed, that is, as the door 31 is moved from its open position (FIGS. 17A, 17B and 17C) to the closed position (FIG. 23), the connective rods 201L and 201R are moved rearward of the apparatus main assembly 100A by the movement of the door 31, whereas the pressing rods 46L and 46R are moved frontward of the apparatus main assembly 100A by the movement of the door 31, through the linkage rods 202L and 202R.

Further, the apparatus main assembly 100A is structured so that the pair of pressing members 42 are movable relative to the pressing member holders 44L and 44R, which are disposed on the inward side of the left and right sub-frame 80L and 80R, respectively, in the vertical direction of the apparatus main assembly 100A, and also, so that they are made by the pressing springs 43 to press on the left and right end portions of the top surface of each cartridge P.

Referring to FIG. 20, each of the left and right pressing member holders 44L and 44R is provided with a pin (shaft) 44*a*, which is at the center of the holder 44 in terms of the front-rear direction. These pins (shafts) 44*a* are fitted in the elongated vertical holes 45, one for one, with which the left and right sub-frames 80L and 80R of the apparatus main assembly 100A are provided.

Further, each of the left and right pressing member holders 44L and 44R is provided with a pair of pins (shafts) 44*b*, which are positioned a preset distance apart from each other in terms of the front-rear direction. These pins (shafts) 44*b* are put through the elongated vertical holes 82, one for one, with which each of the left and right sub-frames 80L and 80R is provided, and are fitted in the guiding holes 48, one for one, with which each of the left and right pressing rods 46L and 46R is provided.

Therefore, the left and right pressing member holders 44L and 44R are regulated in position in terms of the vertical direction of the apparatus main assembly 100A, by the left and right pressing rods 46L and 46R. Further, they are regulated in position in terms of the front-rear direction, by the elongated vertical holes 45 of the left and right sub-frames 80L and 80R, respectively. That is, when the left and right pressing rods 46L and 46R are moved in the front-rear direction, the left and right pressing member holders 44L and 44R are allowed to move only in the vertical direction.

Figure 21:
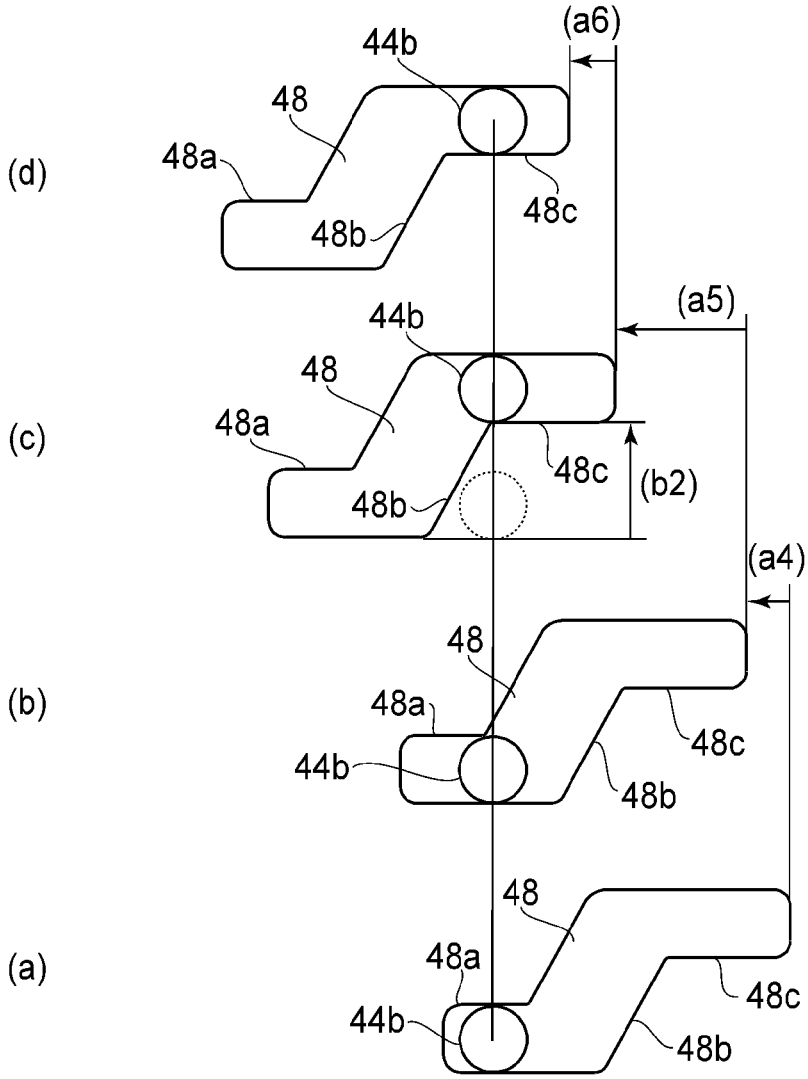
FIG. 21 is an enlarged view of the cartridge tray guiding hole of the means for pressing, and keeping pressed, the cartridge.

FIG. 21 is an enlarged view of the guiding hole 48, and its adjacencies, of the pressing rod 46L, as seen from the left side of the apparatus main assembly 100A. The guiding holes 48 are made up of the first, second, and third guiding ranges 48*a*, 48*b* and 48*c*, respectively. The first guiding range 48*a* horizontally extends in the front-rear direction. The second guiding range 48*b* extends diagonally upward from the front end of the first guiding range 48*a* in the rearward direction. The third guiding range 48*c* horizontally extends from the front (top) end of the second guiding range 48*b* in the rearward direction. It catches the pin (shaft) 44*b*, and securely holds the pin (shaft) 44*b*.

FIG. 21(*a*) shows the positional relationship between the guiding hole 48 and pin (shaft) 44*b* when the door 31 is completely shut against the apparatus main assembly 100A. That is, when the door 31 is completely closed, the pressing rod 46L is on the frontward side of the apparatus main assembly 100A. Therefore, the pin (shaft) 44*b* (hence, pressing member holder 44L) is regulated in position in terms of the vertical direction, by the first guiding range 48*a*. Further, each pressing member 42 is pressing on the left end portion of the top surface of the corresponding cartridge P.

FIGS. 21(*b*) and 21(*c*) show the positional relationship between the guiding hole 48 and pin (shaft) 44*b* when the door 31 is partially open. As the door 31 is pivotally moved (opened) from the closed position (FIG. 21(*a*)), the pressing rod 46L is moved rearward of the apparatus main assembly 100A by the movement of the door 31. Consequently, the pressing member holder 44L is moved upward by the pressing rod 46L while being guided by the second guiding range 48*b* of the guiding hole 48.

During this upward movement of the pressing member holder 44L, it does not occur that the pressing member holder 44L horizontally moves, because the pin (shaft) 44*a* of the pressing member holder 44L is in the vertically elongated hole 45. In other words, the pressing member holder 44L moves only in the vertical direction. Consequently, the pressing member 42 is separated from the top surface of each cartridge P.

FIG. 21(*d*) shows the positional relationship between the guiding hole 48 and pin (shaft) 44*b* when the door 31 is fully open. When the door 31 is in the state shown in FIG. 21(*d*), the pressing rod 46L is in its rearward position in the apparatus main assembly 100A. Therefore, the pin (shaft) 4*b* (hence, pressing member holder 44L) is prevented from vertically moving, by the third guiding range 48*c* of the guiding hole 48. Therefore, the pressing member 42 is kept separated from the top surface of the left end portion of each cartridge P.

FIG. 21 is illustrates the mechanism for causing the pressing member 42 to keep on pressing on the left end portion of each cartridge P, or allowing the pressing member 42 to separate from the cartridge P. As for the mechanism for causing the pressing member 42 to keep on pressing on the right end portion of each cartridge P, it is similar to the one shown in FIG. 21.

Therefore, while the left and right pressing rods 46L and 46R are horizontally moved by the distance a4, by the pivotal opening movement of the door 31, the pins (shaft) 44*b* (hence, left and right pressing member holders 44L and 44R) are regulated in position in terms of the vertical direction, by the first guiding range 48*a*. Thereafter, the pins (shaft) 44*b* (hence, left and right pressing member holders 44L and 44R) are vertically moved by a distance b2, by the second guiding range 48*b*, while the left and right pressing rods 46L and 46R are moved by a distance a5 by the movement of the door 31.

Lastly, while the left and right pressing rods 46L and 46R are horizontally moved by a distance a6, they are regulated in position in terms of the vertical direction, by the third guiding range 48*c*. Incidentally, the vertically elongated holes 82, with which the left and right sub-frames 80L and 80R are provided, one for one, are large enough not to interfere with the vertical movement of the pins 44*b*, which occurs during the opening or closing of the door 31.

Figure 22:
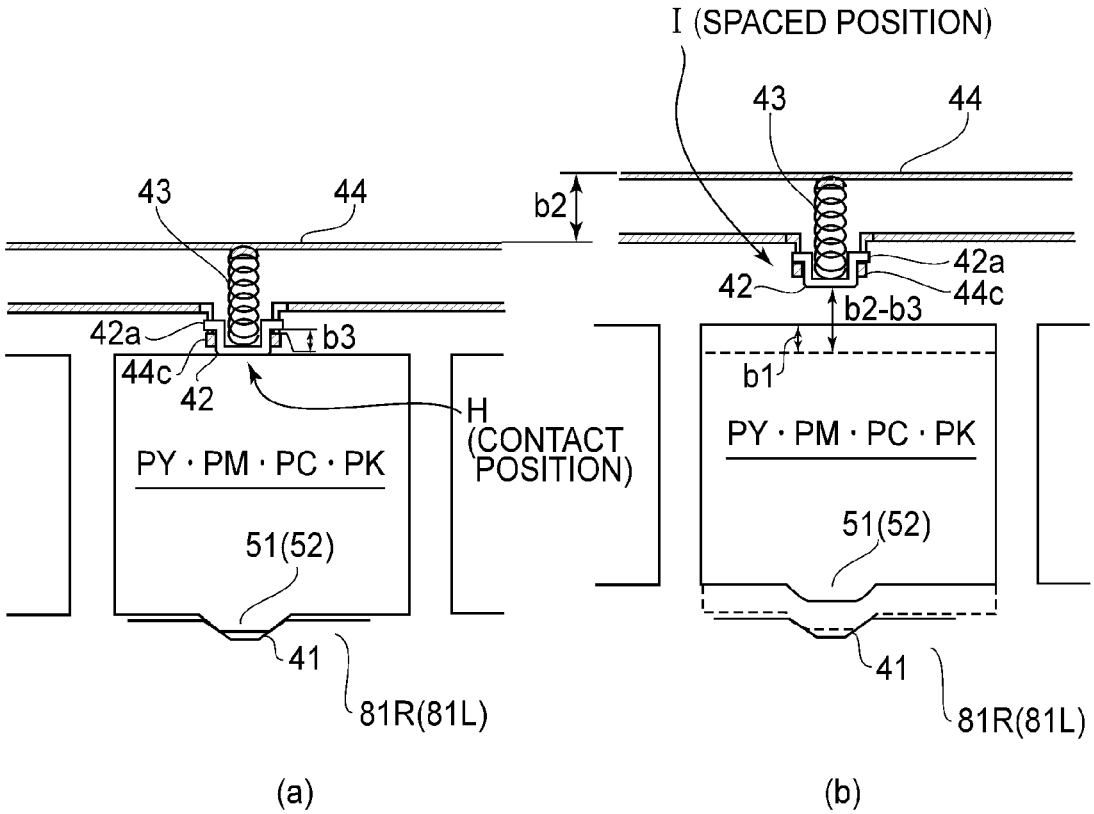
FIG. 22 is a drawing (1) illustrating the means for pressing, and keeping pressed, the cartridge.

FIGS. 22(*a*) and 22(*b*) illustrate the manner in which the left and right end portions of one of the cartridges P in the tray 35 are placed in contact with, or separated from, the corresponding pressing members 42. That is, each of FIGS. 22(*a*) and 22(*b*) is a part of the sectional view of the apparatus main assembly 100A, at a vertical plane parallel to the moving direction of the tray 35, as seen from the left side of the apparatus main assembly 100A. It shows the cartridge P, pressing member 42, pressing spring 43, and pressing member holder 44.

FIG. 22(*a*) shows the combination of the cartridge P, pressing member 42, pressing spring 43, and pressing member holder 44 when the door 31 is closed (closed position A), and each cartridge P is under the pressure applied thereto from the pressing spring 43 through the pressing member 42, and in its preset image formation position. As the door 31 is pivotally moved into the closed position A, the pressing member holder 44 and pressing member 42 are pressed down by the first guiding range 48*a* of the pressing rod 46. However, the pressing member 42 is stopped as it comes into contact with the left and right portions of the top surface of the cartridge P, being thereby prevented from moving downward further. Consequently, a gap (distance b3) is created between the pressing member engaging portion 44*c*, with which the pressing member holder 44 is provided, and the pressing member holder engaging portion 42*a* of the pressing member 42.

That is, when the door 31 is in its closed position A, the pressing member 42 is in its cartridge contacting position H, in which it keeps the corresponding cartridge P fixed in position, by remaining in contact with the cartridge P. More concretely, the pressing member 42 is made by the pressure it receives from the pressing spring 43, to press on the left and right end portions of the top surface of the cartridge P. Thus, the driving-side bearing 51 and no-driving-side bearing 52 of the cartridge P are kept in contact with the corresponding bearing positioning portions 41, being thereby prevented from moving.

The direction in which the pressing member 42 is moved to be placed in contact with the cartridge P is as follows. That is, it is perpendicular to the direction (engaging direction) in which the drum driving coupling 39 and development roller driving coupling 40, which are driving force transmitting members (which will be described later), engage with the counterparts of the cartridge P, and also, the direction (contacting direction) in which the aforementioned power supplying member 75 comes into contact with the cartridge P (contacting direction).

FIG. 22(*b*) shows the positional relationship among the abovementioned components when the door 31 is fully open (in open position B), and therefore, each cartridge P is free from the pressure from the pressing spring 43, having therefore been moved upward from the image formation position. More concretely, as the door 31 is opened, the pressing rod 46 is moved rearward of the apparatus main assembly 100A by the movement of the door 31. Thus, the pressing member holder 44 is kept in its top position by the third guiding range 48*c* of the pressing rod 46. As the pressing member holder 44 is moved upward by the distance b3, from its position shown in FIG. 22(*a*), in which it causes the pressing member 42 (pressing spring 43) to press on the cartridge P, the pressing member contacting portion 44*c* of the pressing member holder 44 comes into contact with the pressing member holder contacting portion 42*a* of the pressing member 42.

Thereafter, therefore, the pressing member holder 44 and pressing member 42 are moved upward together. As described above, the amount (b2−b3) by which the pressing member 42 is moved upward is greater than the above described amount (b1) by which each cartridge P is moved upward. Therefore, each cartridge P is freed from the pressure applied by the pressing spring 43 (pressing member 42), and the pressing member 42 is retracted to its preset position in which it does not interfere with the horizontal movement of the tray 35.

That is, when the door 31 is in its open position B, the pressing member 42 is in its separation position I, in which it remains separated from the cartridge P. In other words, as the door 31 is opened, each cartridge P is freed by the pivotal opening movement of the door 31, from the pressure applied to the cartridge P in the left-right direction.

(Structure of Driving Force Transmitting Coupling)

Figure 25:
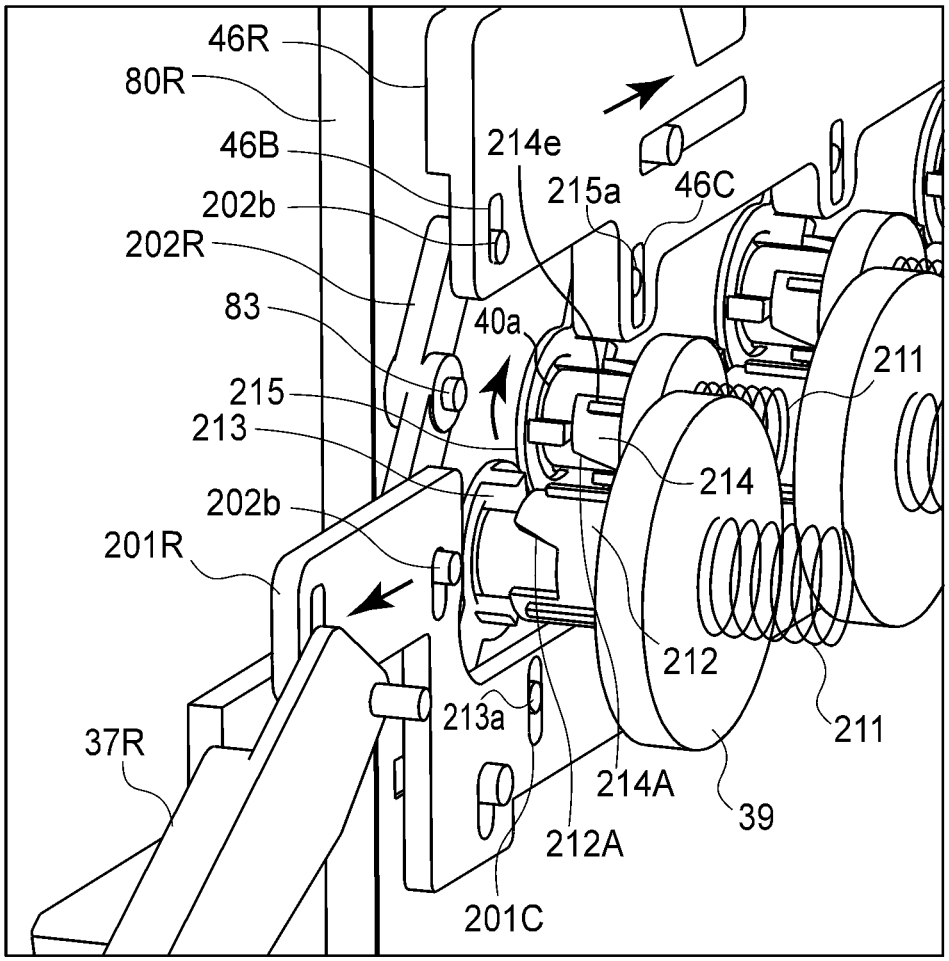
FIG. 25 is a drawing (2) illustrating the means for transmitting the cartridge driving force to the cartridge.

Referring to FIGS. 19 and 25, the apparatus main assembly 100A is provided with the drum driving force transmitting coupling 39 and development roller driving force transmitting coupling 40, which are on the inward side of the sub-frame 80R of the apparatus main assembly 100A. The drum driving coupling 39 and development roller driving coupling 40 are the driving force output portions (driving force transmitting members) of the apparatus main assembly 100A, which are engaged with the driving force input portions (driving force transmitting portion engaging portions) 53 and 54 of the cartridge P to transmit rotational driving force to the drum 1 and development roller 3*a* of each cartridge P.

Figure 24:
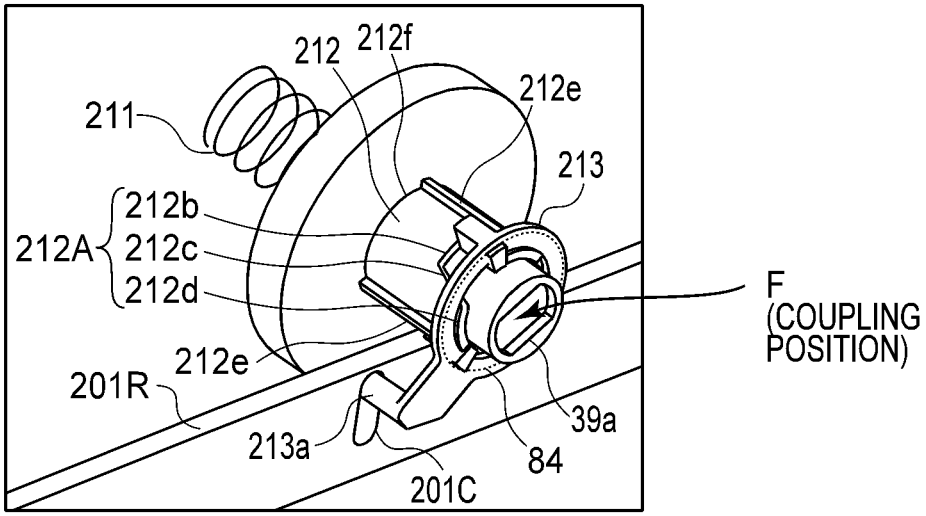
FIG. 24 is a drawing (1) illustrating the means for transmitting the cartridge driving force to the cartridge.
Figure 24:
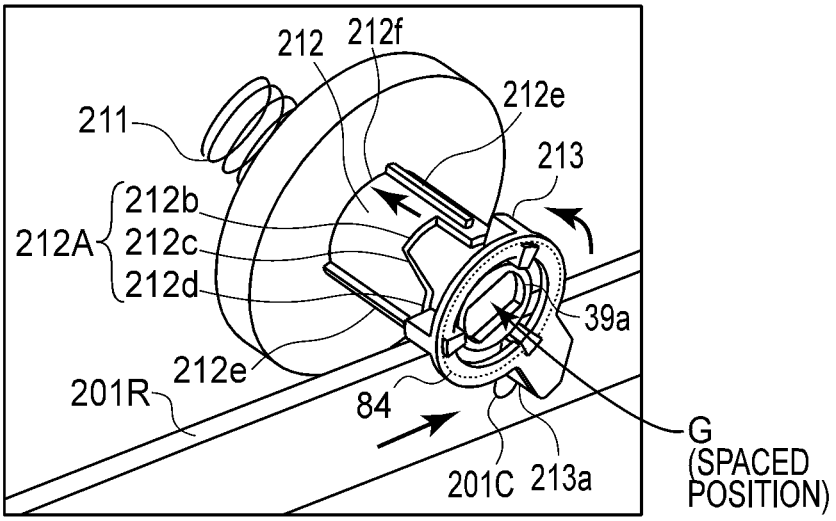

FIG. 24 is an enlarged view of the combination of the drum driving coupling 39 of the apparatus main assembly 100A and the driving force input portion 53 of the cartridge P. It shows the manner in which the couplings 39 and 53 are engaged with each other, or disengaged from each other. For the sake of the simplification of description, the right sub-frame 80R of the apparatus main assembly 100A, and cartridge P, are not shown in FIG. 24. FIG. 25 is a perspective view of the combination of the drum driving coupling 39 and development roller driving coupling 40, and its adjacencies, as seen from the right side of the apparatus main assembly 100A, when the door 31 is fully open (in open position B). It shows the structure of the combination, and its adjacencies.

The drum driving coupling 39 and development roller driving coupling 40 are rotatably supported by the right sub-frame 80R in such a manner that they are moveable in the direction parallel to their axial line, relative to the unshown driving unit shafts, which are outside the right sub-frame 80R. They are under the pressure generated by the coupling pressing springs (pressing means: pressing members) 211, in the direction to cause the coupling portions 39*a* and 40*a* to engage with the driving force input portions 53 and 54 of the cartridge P.

Referring to FIGS. 17A, 17B and 17C, the right sub-frame 80R is provided with four round holes 84, the centerline of each of which coincides with the axial line of the corresponding drum driving coupling 39. A drum driving coupling disengagement lever 213 is fitted in the round hole 84, in such a manner that it can be pivotally moved (FIG. 24).

Next, referring to FIGS. 24 and 25, one end of the drum driving coupling disengagement lever 213 is provided with a pin (shaft) 313*a*, which is fitted in the vertically elongated hole 201C, with which the right connective rod 201R is provided. Further, a drum driving coupling disengagement cam 212 is in engagement with the drum driving coupling disengagement lever 213. It is movable in the direction parallel to the axial line of the drum driving coupling 39.

Further, the drum driving coupling disengagement cam 212 is provided with a rib 212*e*, which is held by an unshown holding member, in such a manner that the drum driving coupling disengagement cam 212 is prevented from moving in the rotational direction of the drum driving coupling disengagement lever 213.

FIG. 24(*a*) is an enlarged view of the drum driving coupling 39 and its adjacencies, when the door 31 is completely shut against the apparatus main assembly 100A (closed position A). When the drum driving coupling 39 is in the state shown in FIG. 24(*a*), it is kept by a coupling pressing spring 211 in a preset position in which its coupling portion 39*a* is protruding inward of the apparatus main assembly 100A far enough to remain in engagement with the driving force input portion 53 of the cartridge P in the apparatus main assembly 100A. That is, when the door 31 is in its closed position A, the drum driving coupling 39 is in its engagement position F, in which it can transmit driving force to the driving force input portion 53 of the cartridge P.

FIG. 24(*b*) shows the state of the drum driving coupling 39 when the door 31 is fully open (open position B). As the door 31 is pivotally moved (opened) from its closed position A to its open position B, the right connective rod 201R is moved frontward of the apparatus main assembly 100A by the movement of the door 31. Thus, the drum driving coupling disengagement lever 213 is pivotally moved relative to the drum driving coupling disengagement cam 212. Consequently, the drum driving coupling disengagement cam 212 is moved rightward of the apparatus main assembly 100A in the direction parallel to the rotational axis of the drum driving coupling disengagement cam 212, by the surface 212A of the drum driving coupling disengagement cam 212.

Thus, the end surface 212*f* of the drum driving coupling disengagement cam 212 comes into contact with the drum driving coupling 39, causing the drum driving coupling 39 to move in the direction to separate from the driving force input portion 53 of the cartridge P, against the pressure generated by the coupling pressing spring 211. That is, when the door 31 is in its open position B, the drum driving coupling 39 is in its separation position G, in which it remains separated from the cartridge P.

Similarly, the right sub-frame 80R is provided with a round hole 85, the axial line of which coincides with the axial line of the development roller driving coupling 40. The development roller driving coupling disengagement lever 215 is rotatably fitted in the round hole 85 (FIGS. 17 and 25).

One end of the development roller driving coupling disengagement lever 215 is provided with a pin (shaft) 215*a*, which is fitted in the vertically elongated hole 46C, with which the right pressing rod 46R is provided.

Further, the development roller driving couple disengagement cam 214 is in engagement with the development roller driving coupling disengagement lever 215, being enabled to be moved in the direction parallel to the rotational axis of the development roller driving coupling 40. Further, the rib 214*e*, with which the development roller driving coupling disengagement cam 214 is provided, is held by an unshown holding member. Therefore, the development roller driving coupling disengagement cam 214 is regulated in its movement in terms of the direction in which the development roller driving couple disengagement lever 215 is pivotally moved.

Thus, as the door 31 is opened, that is, as it is pivotally moved from its closed position A to its open position B, the right connective rod 201R is moved frontward of the apparatus main assembly 100A by the movement of the door 31, whereby the pressing rod 46R is moved rearward of the apparatus main assembly 100A by the frontward movement of the right connective rod 201R, through the linkage rod 202R. Thus, the development roller driving coupling disengagement lever 215 is pivotally moved relative to the development roller driving coupler disengagement cam 214.

Further, the development roller driving coupling disengagement cam 214 is moved rightward of the apparatus main assembly 100A, along the rotational axle of the development roller driving coupling 40, by the surface 214A of the development roller driving couple disengagement cam 214. Therefore, the end surface of the development roller driving couple disengagement cam 214 comes into contact with the development roller driving coupling 40, causing the development roller driving coupling 40 to move in the direction to separate from the driving force input portion 54 of the cartridge P, against the pressure generated by the coupling pressing spring 211.

That is, as the door 31 is opened, the drum driving coupling 39 and development roller driving coupling 40 are vertically moved relative to the tray 35, and also, are retracted into the area in which they do not regulate the tray 35 and each cartridge P in their horizontal movement.

Referring to FIG. 24, the surface 212A of the drum driving coupling disengagement cam 212 is made up of straight portions 212*b* and 212*d*, and a slanted portion 212*c*. Thus, when the door 31 is completely shut against the apparatus main assembly 100A (closed position A), the drum driving coupling 39 remains in engagement with the corresponding cartridge P (engagement position F), whereas the door 31 is fully open (open position B), it remains separated from the corresponding cartridge P (separation position G).

The surface 214A of the development roller driving couple disengagement cam 214 is similarly structured to that of the drum driving coupling disengagement cam 212. Thus, when the door 31 is completely shut against the apparatus main assembly 100A (closed position A), the development roller driving coupling 40 also remains in engagement with the corresponding cartridge P (engagement position F), whereas when the door 31 is fully open (open position B), the development roller driving coupling 40 remains separated from the corresponding cartridge P (remains in separation position G).

(Operational Timing of Interface Portions)

The image forming apparatus 100 is provided with the above described mechanism. Therefore, as the door 31 is moved from its closed position A to its open position B, the interface portions of the apparatus main assembly 100A, which correspond one for one to the cartridges P, are made by the movement of the door 31 to disengage from the cartridges P. More concretely, the springy electrical contacts 75, pressing members 42, drum driving couplings 39, and development roller driving couplings 40 of the apparatus main assembly 100A are disengaged from the cartridges P. Further, as the tray 35 is moved by the tray holding member 34 from its image formation position C to its unlocking (locking) position D, it becomes possible for the tray 35 to be freely slid between the unlocking (locking) position D and cartridge mounting (dismounting) position E.

Therefore, the tray 35 can be pulled out of the apparatus main assembly 100A so that cartridges P can be mounted into the tray 35, or the cartridges P in the tray 35 can be replaced, or the tray 35 can be pushed back into the apparatus main assembly 100A.

As described above, the springy electrical contacts 75, pressing members 42, drum driving couplings 39, development roller driving couplings 40, and tray 35 of the apparatus main assembly 100A are moved by the movement of the door 31. As for the timing with which each of the abovementioned components is moved, it can be adjusted by changing the above described mechanism for regulating the movement of these components, in the profile of the surface of the cams of the above described movement controlling mechanism.

For example, the timing with which the tray 35 is vertically moved can be adjusted by adjusting the guiding range 36*b* of the guiding hole 36, in position in terms of the horizontal direction, within the range of the guiding hole 36. By configuring the guiding hole 36 so that the guiding range 36*a* is longer and the guiding range 36*c* is shorter, than they are in this embodiment, it is possible to cause the tray 35 to descent at a point closer to the starting of the closing of the door 31 (sooner after door 31 begins to be closed).

Similarly, the timing with which the springy electrical contacts 75 of the apparatus main assembly 100A are moved can be adjusted by modifying in profile the cam portion 201D (FIG. 18) of the connective rod 201L.

The timing which the pressing members 42 are moved can be adjusted by modifying in shape the guiding hole 48 (FIG. 21) of the pressing rod 46.

The timing with which drum driving coupling 39 is moved can be adjusting in profile the surface of the cam portion 214 (FIG. 25) of the development roller driving coupling 214.

In this embodiment, the timings with which the abovementioned components begin to be moved are set so that these components are sequentially moved in the following order, by the closing movement of the door 31.

Toward the end of the diagonally downward movement of the left and right tray holding members 34L and 34R caused by the second guiding range 36*b* of the guiding portion 36, the pins (shafts) 34*c* and 34*d* are in the first guiding range 36*a* of the guiding portion 36, that is, one of the horizontal guiding ranges of the guiding portion 36. That is, as the left and right tray holding members 34L and 34R are moved in the diagonally downward direction, the driving-side bearing 51 and no-driving-side bearing 52 of each cartridge P are caught by their bottom surface, by the bearing positioning portions 41, with which the left and right positioning members 81L and 81R of the apparatus main assembly 100A, one for one, are provided.

As the drum driving coupling disengagement lever 213 is rotationally moved, the drum driving coupling disengagement cam 212 is moved inward of the apparatus main assembly 100A by the slanted surface portion 212*c* of the drum driving coupling disengagement cam 212. That is, the drum driving coupling 39 is under the pressure generated by the coupling pressing spring 211. Therefore, the drum driving coupling 39 engages with the driving force input portion 53 of the corresponding cartridge P. Similarly, as the development roller driving coupling disengagement lever 215 is pivotally moved, the development roller driving coupling 40 is moved inward of the apparatus main assembly 100A by the slanted surface portion 214*c*. Since the development roller driving coupling 40 is under the pressure generated by the coupling pressing spring 211, the development roller driving coupling 40 engages with the driving force input portion 54 of the cartridge P.

Thus, each cartridge P is subjected to the pressure generated by the coupling pressing spring 211, through the drum driving coupling 39 and development roller driving coupling 40, being thereby moved leftward of the apparatus main assembly 100A. Thus, the protrusion 57 of the cartridge P, which is for positioning the cartridge P in terms of the left-right direction, comes into contact with the left sub-frame 80L of the apparatus main assembly 100A. Consequently, the cartridge P is accurately positioned relative to the apparatus main assembly 100A in terms of the left-right direction.

The left and right pressing rods 44 are made to move diagonally downward by the second guiding range 48*b* of the guiding hole 48 with which the pressing rod 46 is provided, causing thereby the left and right pressing members 42 to downwardly move. Thus, the left and right pressing members 42 press on the left and right end portion of the top surface of the cartridge P, causing thereby the cartridge P to move downward. Consequently, the driving-side bearing 51 and no-driving-side bearing 52 of the cartridge P are immovably fit into the bearing positioning portions 41.

The electrical contact holder 76 of the apparatus main assembly 100A is moved inward of the apparatus main assembly by the slanted portion 201*f* of the connective rod 201L. Thus, the cartridge electrical contact contacting portion 77 of springy electrical contact 75 of the apparatus main assembly 100A is placed in contact with the electrical contact 55 of the cartridge P, establishing thereby electrical connection between the contacts 75 and 55.

The above-described timings with which these components begin to be moved may be summarized as follows: As the door 31 is moved from its open position B (FIG. 3) to its closed position A (FIG. (2), the following operations (1)-(4) are made to sequentially occur in the numerical order, by the movement of the door 31, which is one of the characteristic features of this embodiment.

(1) Movement of the tray 35 from its tray locking (unlocking) position D to its image formation position C (FIG. 4→FIG. 2).

(2) Movement of driving force transmitting members 39 and 40 from their separation position G to their engagement position F (FIG. 24(*b*)→FIG. 24(*a*)).

(3) Movement of pressing member 42 from its separation position I to its contact position H (FIG. 22(*b*)→22(*a*)).

(4) Movement of power supplying member 75 from its separation position K to its power supplying position J (FIG. 18(*b*)→(*a*)).

When the door 31 is opened, the above described movements are made to occur in the reverse order ((4)→(3)→(2)→(1)). That is, as the door 31 is opened, first, the power supplying member 75 separates. Next, the left and right pressing members 42 separate. Then, the driving couplings 39 and 40 separate. Lastly, the tray 35 moves upward (from image formation position C to tray locking (unlocking) position D).

Next, the merits of setting, as described above, the order in which these movements are triggered are described. While the door 31 is opened, first, the driving force input portions 53 and 54 of each cartridge P are moved to where they oppose the drum driving coupling 39 and development roller driving coupling 40, respectively, in Step (1).

Then, the drum driving coupling 39 and development roller driving coupling 40 are placed in contact with the driving force input portions 53 and 54 of the cartridge P in Step (2), ensuring that the drum driving coupling 39 and development roller driving coupling 40 are engaged with the driving force input portions 53 and 54, respectively, of the cartridge P.

On the other hand, while the door 31 is closed, first, drum driving coupling 39 and development roller driving coupling 40 are separated from the driving force input portions 53 and 54 of the cartridge P, respectively. Then, each cartridge P is moved upward along with the tray 35. If a cartridge P is moved upward along with the tray 35 while the driving couplings 39 and/or 40 are remaining in engagement with the driving force input portions 53 and/or 54, respectively, the cartridge P is tilted so that its lengthwise end, by which the cartridge P is in engagement with the driving couplings of the apparatus main assembly 100A, is positioned higher than its opposite end. Consequently, the cartridge is twisted across its portion between the lengthwise end portions at which the cartridge P is supported by the apparatus main assembly 100A, making it possible for the driving couplings to be damaged.

Further, if the tray 35 is moved upward while the driving coupling(s) are still protruding inward of the apparatus main assembly 100A through the hole of the right sub-frame 80R, the driving coupling(s) comes into contact with the right piece 35*e* of the tray 35, making it possible for the driving coupling(s) to be damaged.

That is, this is why Step (2) is carried out after the completion of Step (1) to prevent the drum driving coupling 39 and/or development roller driving coupling 40 from being damaged by being twisted at the point of engagement between the apparatus main assembly 100A and cartridge P, and/or their contact with the right piece 35*e* of the tray 35.

Further, each cartridge P is moved leftward in Step (2), whereby the protrusion 57 of the cartridge P, which is for positioning the cartridge P relative to the apparatus main assembly 100A in terms of the left-right direction, is placed in contact with the left sub-frame 80L.

More concretely, as described above, the apparatus main assembly 100A has the coupling pressing springs (pressing means) 211 which keep the drum driving coupling 39 and development roller driving coupling 40 pressed on the driving force input portions 53 and 54 of the cartridge P. Thus, the cartridge P is pressed by these springs 21, from the side where the driving force input portions 53 and 54 are, toward the side where the power supplying contacts 55 are. Consequently, the cartridge P is moved leftward, and therefore, the protrusion 57 of the cartridge, which is for positioning the cartridge P relative to the apparatus main assembly 100A, is placed in contact with the left sub-frame 80L.

Thereafter, in Step (3), the left and right end portions of the top surface of each cartridge P are pressed, whereby the bearing 51 on the driving side, and bearing on the no-driving side, are fitted in the bearing positioning portions 41, being thereby fixed in position. Thus, it is ensured that each cartridge P is precisely position relative to the main frame of the apparatus main assembly 100A in terms of the left-right direction.

Incidentally, in Step (2), the bearings 51 and 52 of each cartridge P are placed in contact with the bearing positioning portions 41, one for one. However, the amount of resistance, which the bearings 51 and 52 are subjected as they are vertically lowered into the bearing positioning portions 41 is relatively small. Therefore, the friction which occurs as each cartridge P is moved leftward of the apparatus main assembly 100A is also relatively small. Therefore, it does not occur that the bearings 51 and 52 are frictionally shaved by the bearing positioning portions 41. Further, in Step (2), the springy electrical contact 75, with which the no-driving side of the apparatus main assembly 100A is provided, remains separated from the electrical contact 55 of each cartridge P. Therefore, it does not occur that when each cartridge P is moved leftward of the apparatus main assembly 100A, it is subjected to such force that interferes with its leftward movement, by the no-driving side.

That is, the movement of each cartridge is not interfered by the cartridge pressing mechanism and power supplying mechanism. Therefore, the resiliency of the coupling pressing spring 211 has only to be strong enough to move the corresponding cartridge P leftward of the apparatus main assembly 100A. As described above, while the door 31 is opened, the drum driving coupling 39 and development roller driving coupling 40 are horizontally moved against the resiliency of the coupling pressing spring 211. Thus, the amount of force necessary to open the door 31 can be reduced by reducing the coupling pressing spring 211 in resiliency.

Also in Step (3), the left and right end portions of the top surface of each cartridge P are pressed, whereby the bearing 51 on the driving side, and bearing on the no-driving side, are fitted into the bearing positioning portions 41, being thereby fixed in position. Thereafter, in Step (4), electrical connection is established between the springy electrical contact 75 of the apparatus main assembly 100A and the electrical contact 55 of the cartridge P. Therefore, it does not occur that the contact pressure between the springy electrical contact 75 of the apparatus main assembly 100A and the electrical contact 55 of the cartridge P pushes back (rightward of apparatus main assembly 100A) the cartridge P.

Further, each cartridge P is positioned so that its protrusion 57 for positioning the cartridge P in terms of the left-right direction remains in contact with the left sub-frame 80L through Step (2). Then, it is ensured in Step (3) that each cartridge P remains fixed in position to the location into which the cartridge P has been moved. Therefore, it is ensured that the positional relationship between the springy electrical contact 75 of the apparatus main assembly 100A and the electrical contact 55 of the cartridge P in terms of the left-right direction of the apparatus main assembly 100A remains as it is preset. Thus, it is possible to reduce the image forming apparatus 100 in the amount of the stroke of the springy electrical contact 75 of the apparatus main assembly 100A, and therefore, to reduce the amount of the force of which a user is required to open or close the door 31.

That is, in this embodiment, while the door 31 is opened, Steps (1)-(4) are sequentially carried out. Therefore, not only can this embodiment reduce the amount of force necessary to open or close the door 31, but also, can ensure that each cartridge P is precisely positioned relative to the main frame of the apparatus main assembly 100A, for the reasons given above.

Incidentally, it is not mandatory that Steps (1)-(4) are carried out so that they do not overlap. For example, Step (2) may be started while Step (1) is carried out. That is, all that is necessary is that Step (1) is finished before the drum driving coupling 39 and development roller driving coupling 40 begin to be placed in contact with the driving force input portions 53 and 54 of the corresponding cartridge P. That is, all that is necessary is that the movement of the driving force input portions 53 and 54 of each cartridge P to where they oppose the drum driving coupling 39 and development roller driving coupling 40, respectively, is completed before Step (2) is started.

Further, from the standpoint of reducing the image forming apparatus 100 in the amount of force necessary to open the door 31, it is desired that the cartridges P are made slightly different in the timing with which each of Steps (2)-(4) begins to be carried out. For example, it is desired that the cartridges P are made slightly different in the timing with which the drum driving coupling 39 is placed in contact with the driving force input portion 53 of the cartridge P (PY, PM, PC and PK), so that the amount of load to which the door 31 is subjected is chronologically distributed.

Further, the timing with which the drum driving coupling 39 is placed in contact with the driving force input portion 53 of the cartridge P, may be slightly different from the timing with which the development roller driving coupling 40 is placed in contact with the driving force input portion 54 of the cartridge P, so that the load to which the door 31 is subjected is chronologically distributed. With the employment of this arrangement, it is possible to reduce the image forming apparatus 100 in the amount of force to which the door 31 is subjected when the door 31 is opened or closed, and therefore, to reduce the amount of force required of a user to open the door 31.

(Merits of Positioning Cartridge relative to Lateral Wall of Apparatus Main Assembly 100A)

In this embodiment, as described above, the protrusion 57 of each cartridge P, which is for positioning the cartridge relative to the apparatus main assembly 100A in terms of the left-right direction of the apparatus main assembly 100A is placed in contact with the left sub-frame 80L of the apparatus main assembly 100A by the resiliency of the coupling pressing spring (pressing member) 211, in order to position the cartridge P relative to the apparatus main assembly 100A in terms of the left-right direction of the cartridge.

That is, the apparatus main assembly 100A has the pressing member 211, which is for pressing a cartridge P from one side of the apparatus main assembly 100A to the other in the apparatus main assembly 100A, in terms of the direction perpendicular to the direction in which the tray 35 is moved inward or outward of the apparatus main assembly 100A along the surface along which the tray 35 is moved. In this embodiment, the pressing members 211 are inside the driving force transmitting members 39 and 40, one for one.

Further, the cartridges P are positioned relative to the main frame of the apparatus main assembly 100A, in terms of the abovementioned perpendicular direction, as the cartridge positioning protrusion 57 of the cartridge P is placed in contact with, that is, caught by, the left sub-frame 80L of the apparatus main assembly 100A, by being pressed by the pressing member 211, when the tray 35 is in the image formation position C while the cartridges P are in the tray 35. Pressing of the cartridge P by the pressing member 211, and removal of the pressure applied by the pressing member 211, from the cartridge P, are caused by the operation for opening or closing the door 31.

In this embodiment, the above described perpendicular direction is the same as the lengthwise direction (parallel to axial line of drum) in a cartridge P properly positioned in the apparatus main assembly 100A, and the left-right direction of the apparatus main assembly 100A. The left sub-frame 80L is one of the lateral walls of the apparatus main assembly 100A, which opposes the opposite end of a cartridge P in the tray 35 in terms of the above-described perpendicular direction.

Therefore, the image forming apparatus 100 in this embodiment is higher in the accuracy with which the springy electrical contact 75 of the apparatus main assembly 100A is positioned relative to the electrical contact 55 of the cartridge P than any conventional image forming apparatus. That is, it is less in the amount of stroke of the springy electrical contact 75 of the apparatus main assembly 100A, being therefore, smaller in the amount of force required of a user to open or close than any image forming apparatus in accordance with the prior art.

In addition, from the standpoint of improving the above described various units in terms of the positional accuracy relative to the cartridges P in terms of the left-right direction, it is desired to be the left sub-frame 80L that is provided with the units.

In this embodiment, it is to the left sub-frame 80L, relative to which the cartridges P are positioned to be accurately positioned relative to the apparatus main assembly 100A, that the springy electrical contacts 75 of the apparatus main assembly 100A, which are the units for establishing electrical connection between the apparatus main assembly 100A and the cartridges P in the apparatus main assembly 100A, are attached. Further, the position of the springy electrical contacts 75 of the apparatus main assembly 100A, relative to the apparatus main assembly 100A, in terms of the direction parallel to the axial line of the drum, is set by the left sub-frame 80L. That is, it is the left sub-frame 80L that has the electrical contact unit 75 which establishes electrical connection between the apparatus main assembly 100A and the cartridges P. Further, it is by the left sub-frame 80L that the electrical contact units 75 are positioned in terms of the above-described perpendicular direction.

The laser scanner unit (exposing unit) 11 is held by the exposing device holding member (unshown). Further, the exposing device holding member is fixed to the apparatus main assembly 100A in such a manner that the portion of the exposing device holding member, which is for positioning the exposing device holding member, in terms of the lengthwise direction of the member (left-right direction of apparatus main assembly 100A), is in contact with the left sub-frame 80L. Therefore, the exposing device holding member is accurately positioned relative to the apparatus main assembly 100A in terms of the abovementioned perpendicular direction, by the left sub-frame 80L. Therefore, the image forming apparatus 100 in this embodiment is higher in the accuracy with which the drum 1 is exposed by the beam of laser light outputted by the exposing device than any conventional image forming apparatus.

Further, the intermediary transfer belt unit 12 is fixed to the apparatus main assembly 100A, with its positioning portion (unshown) being placed in contact with the left sub-frame 80L, in terms of its lengthwise direction (left-right direction of apparatus main assembly 100A). That is, the intermediary transfer unit 12, which is disposed so that it opposes the drums 1, and also, so that developer images, are transferred (primary transfer) from the drums 1, and from which the developer images are transferred (secondary transfer) onto a sheet S of recording medium, is accurately positioned relative to the apparatus main assembly 100A by the left sub-frame 80L of the apparatus main assembly 100A.

Therefore, it is possible to improve an image forming apparatus in the accuracy with which the belt 13, driver roller 14, turn roller 15, tension roller 16, and primary transfer roller 17 are positioned relative to the drum 1. Therefore, it is possible to reduce the drum 1, belt 13, driver roller 14, turn roller 15, tension roller 16, and primary transfer roller 17 in their measurement in terms of the left-right direction of the apparatus main assembly 100A. That is, it is possible to reduce the image forming apparatus and cartridge therefor in their size in terms of the left-right direction of the apparatus main assembly 100A, and therefore, in their cost.

Further, the fixing device (fixation unit) 23 is fixed to the apparatus main assembly 100A, with its positioning portion (unshown) for positioning the fixing device 23 in terms of its lengthwise direction, being in contact with the left sub-frame 80L of the apparatus main assembly 100A. That is, the fixing unit 23, which is for applying heat and pressure to a developer image, and the sheet S of recording medium on which the developer image is present, to fix the developer image to the sheet S, is accurately positioned relative to the apparatus main assembly 100A by the left sub-frame 80L.

Therefore, it is possible to improve an image forming apparatus in the accuracy with which its fixing device 23 is positioned. That is, the fixation unit 23 is accurately positioned with reference to the left sub-frame 80L. Therefore, the image forming apparatus is minimized in the positional deviation between the fixing members 23*a* and 23*b* , in terms of the left-right direction of the apparatus main assembly 100A, and the developer image on the belt 13. Therefore, it is possible to reduce the fixing members 23*a* and 23*b* in their dimension in terms of the left-right direction of the apparatus main assembly 100A. That is, it is possible to reduce the fixing members 23*a* and 23*b* in size in terms of the left-right direction of the apparatus main assembly 100A, and therefore, in cost.

Further, the sheet feeder unit 18, in which multiple sheets S of recording medium, onto which a developer image is transferred, are stored, and from which the sheets S are conveyed one by one, are positioned by the left sub-frame 80L in terms of the above described perpendicular direction. Therefore, the image forming apparatus 100 is minimized in the positional deviation between the developer image on the belt 13, and the sheet S of recording medium conveyed out of the sheet feeder unit 18, in terms of the left-right direction. Therefore, it is minimized in the positional deviation between the sheet S of recording medium and the image on the sheet S.

<<Miscellanies>>

(a) The application of the present invention is not limited to such a process cartridge of the all-in-one type as the one in this embodiment that is provided with the image bearing member 1, on which a latent image is formed, and the developing means 3, which is for developing the latent image on the image bearing member 1, with developer.

That is, the present invention is also applicable to a process cartridge of the so-called separation type, which is equipped with the image bearing member 1 on which a latent image is formed, and processing means other than the developing means 3 which is for developing the latent image on the image bearing member 1, with developer.

Further, the present invention is also applicable to a development cartridge which has the developing means for developing the latent image on the image bearing member 1, with the use of developer, and a developer storage in which the developer to be used for developing the latent image.

Further, the present invention is applicable to an image forming apparatus structured so that a combination of a process cartridge of the so-called separation type, and a development cartridge, is supported by its tray 35, and at least one of the process cartridge of the separation type and development cartridge is removably supported by the tray 35.

Moreover, a cartridge to which the present invention is applicable includes a unit in the form of a cartridge, which is removably mountable in the apparatus main assembly 100A and contributes to the process for forming an image on recording medium.

(b) The electrophotographic full-color image forming apparatus in this embodiment is an image forming apparatus in which four cartridges, which are different in the color of the developer they contain, are removably installable. However, this embodiment is not intended to limit the present invention in the number of cartridges installable in the main assembly of an image forming apparatus; the number of the cartridge installable in the image forming apparatus is optional. That is, the present invention is also applicable to an image forming apparatus which employs only one cartridge, and also, an image forming apparatus which employs two, three, or no less than five cartridges. Further, the present invention is applicable to a monochromatic image forming apparatus, that is, an image forming apparatus which employs only one cartridge.

(c) The image forming apparatus 100 in this embodiment is structured so that its tray 35 is linearly moved in the direction parallel to the surface on which the apparatus main assembly 100A is rested. However, this embodiment is not intended to limit the present invention in the direction in which the tray 35 (also, cartridge supporting member) is moved. For example, the present invention is also applicable to an image forming apparatus structured so that its tray 35 is movable in such a direction that is perpendicular to the lengthwise direction of the drum 1, parallel to the surface on which the apparatus main assembly 100A is rested, or diagonally upward or downward. Further, the present invention is also applicable to an image forming apparatus structured so that its tray stopper can be disengaged to remove the tray 35 from the apparatus main assembly 100A.

(d) The present invention is applicable to the image forming apparatus 100 in this embodiment, even if the intermediary transfer unit 12 of the apparatus 100 is replaced with a recording medium conveyance-transfer belt for bearing and conveying a sheet S of recording medium. That is, the present invention is applicable to an image forming apparatus having a transferring device (recording medium conveying-transferring means) which conveying recording medium so that the developer image formed on the drum 1 is directly transferred onto a sheet S of recording medium.

(e) An image forming apparatus to which the present invention is applicable is not limited to an image forming apparatus (printer) such as the one in this embodiment. That is, the present invention is also applicable to an image forming apparatus other than the one in this embodiment. For example, the present invention is also applicable to a copying machine, a facsimile machine, etc., and a multifunction image forming apparatus capable of functioning as two or more of the preceding examples of image forming apparatus.

(f) The application of the present invention is not limited to an image forming apparatus which uses an electrophotographic process. That is, the present invention is also applicable to an image forming apparatus which uses an electrostatic recording process which employs an electrostatically recordable dielectric member, a magnetic recording process which employs a magnetically recordable magnetic member, and the like image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications No. 259492/2012 filed Nov. 28, 2012 and 259493/2012 filed Nov. 28, 2012, which are hereby incorporated by reference.

What is claimed is:

1. An image forming apparatus for forming an image on a recording material, to which apparatus a cartridge is detachably mountable, said image forming apparatus comprising:

a main assembly;

an opening provided in said main assembly;

a main assembly door movable between a closing position for closing said opening and an open position for opening said opening;

a tray for carrying the cartridge, said tray is capable of taking (i) an image forming position in which the cartridge is in a position capable of an image forming operation in said main assembly, when said main assembly door is in the closing position, (ii) a mounting and demounting position for permitting mounting and demounting of the cartridge outside said main assembly, when said main assembly door is in the open position, and (iii) a movable position which is between the mounting and demounting position and the image forming position and in which said tray is movable to the image forming position in interrelation with movement of said main assembly door from the open position to the closing position;

a supporting member movably supporting said tray and movable in interrelation with said main assembly door;

a drive transmission member capable of taking a connecting position for transmitting a driving force to the cartridge when said main assembly door is in the closing position, and a first spacing position for spacing from the cartridge when said main assembly door is in the open position;

an urging member capable of taking a contact position in which said urging member urges the cartridge to said main assembly when said main assembly door is in the closing position, and a second spacing position for spacing from the cartridge when said main assembly door is in the open position; and an electric energy supply member capable of taking an electric energy supplying position for supplying electric energy to an electric power supply contact portion of the cartridge when said main assembly door is in the closing position, and a third spacing position for spacing from said electric power supply contact portion the cartridge when said main assembly door is in the open position, wherein in interrelation with the movement of said main assembly door from the open position to the closing position, (i) movement of said tray from the movable position to the image forming position, (ii) movement of said drive transmission member from the first spacing position to the connecting position, (iii) movement of said urging member from the second spacing position to the contact position, and (iv) movement of said electric energy supply member from the third spacing position to the electric energy supplying position, are carried out in the order named.

2. An apparatus according to claim 1, wherein in interrelation with the movement of said main assembly door from the closing position to the open position, (i) movement of said electric energy supply member from the electric energy supplying position to the third spacing position, (ii) movement of said urging member from the contact position to the second spacing position, (iii) movement of said drive transmission member from the connecting position to the first spacing position, and (iv) movement of said tray from the image forming position to the movable position, are carried out in the order named.

3. An apparatus according to claim 1, wherein the cartridge includes an image bearing member on which a latent image is formed, and said main assembly includes a transfer unit for contacting the image bearing member to transfer a developer image formed on the image bearing member, wherein in the image forming position of said tray, the image bearing member and said transfer unit are in contact with each other.

4. An apparatus according to claim 3, wherein said transfer unit includes an intermediary transfer member for receiving the developer image from the image bearing member and transferring the received developer image onto the recording material.

5. An apparatus according to claim 3, wherein said transfer unit includes a recording material feeding member for feeding the recording material so as to transfer the developer image directly onto the recording material.

6. An apparatus according to claim 3, wherein the image bearing member is an electrophotographic photosensitive member.

7. An apparatus according to claim 1, wherein a moving direction of said tray between the mounting and demounting position and the movable position is a direction perpendicular to a longitudinal direction of the cartridge carried on said tray.

8. An apparatus according to claim 1, wherein the cartridge is provided, at one end portion side with respect to the longitudinal direction, with a drive connecting portion for receiving a driving force from said drive transmission member, and is provided, at the other end portion side, with an electric power supply contact portion, and said main assembly includes urging means for urging said drive transmission member to the drive connecting portion when said main assembly door is in the closing position, and wherein in interrelation with movement of said drive transmission member from the spacing position to the connecting position, said urging means moves the cartridge in a direction which is from the side provided with the drive connecting portion to the side provided with the electric power supply contact portion.

9. An apparatus according to claim 1, wherein a direction in which said urging member urges the cartridge is perpendicular to a direction in which said drive transmission member is connected and perpendicular to a direction in which said electric energy supply member is brought into contact.

10. An apparatus according to claim 1, wherein said tray is capable of carrying a plurality of the cartridges in a moving direction of said tray between the mounting and demounting position and the movable position.

11. An apparatus according to claim 1, wherein said tray is linearly movable between the mounting and demounting position and the movable position horizontally, angularly upwardly or angularly downwardly relative to a floor on which said main assembly is installed.

12. An apparatus according to claim 1, wherein said tray carries the cartridge so that the cartridge is demountable upwardly in the mounting and demounting position and so that the cartridge is mountable downwardly in the mounting and demounting position.

13. An apparatus according to claim 1, wherein the cartridge is a process cartridge including an image bearing member on which a latent image is formed, and developing means for developing the latent image formed on the image bearing member with a developer.

14. An apparatus according to claim 1, wherein the cartridge is a separable type process cartridge including an image bearing member on which a latent image is formed, and image forming process means other than developing means for developing the latent image formed on the image bearing member with a developer.

15. An apparatus according to claim 1, wherein the cartridge is a developing cartridge including developing means for developing a latent image formed on an image bearing member, and a developer accommodating portion accommodating the developer to be used by the developing means.

16. An apparatus according to claim 1, wherein the cartridge is a combination of (i) a process cartridge including an image bearing member on which a latent image is formed, and image forming process means other than developing means for developing the latent image with a developer, and developing means for developing the latent image with a developer, and (ii) a developer accommodating portion accommodating the developer to be used by the developing means.

* * * * *